United States Patent [19]

Halle et al.

[11] 4,063,859

[45] Dec. 20, 1977

[54] APPARATUS FOR PRODUCING SHAPED CONCRETE PRODUCTS

[75] Inventors: Gary L. Halle, Neenah; Albert Van Lith, Kimberly, both of Wis.

[73] Assignee: Gary L. Halle, Neenah, Wis.

[21] Appl. No.: 701,866

[22] Filed: July 1, 1976

[51] Int. Cl.[2] ..... B28B 3/02

[52] U.S. Cl. ..... 425/139; 249/144; 249/161; 425/145; 425/150; 425/165; 425/167; 425/259; 425/422; 425/441; 425/444; 425/454

[58] Field of Search ..... 425/125, 157, 162, 165, 425/167, 256, 258, 412, 421, 422, 436, 441, 444, 447, 454, 455, 139, 145, 150, 259; 249/57, 144, 161

[56] References Cited

U.S. PATENT DOCUMENTS

| | | | |
|---|---|---|---|
| 2,598,254 | 5/1952 | Grueneberg | 425/162 |
| 2,888,731 | 6/1959 | McElroy et al. | 425/157 |
| 3,499,069 | 3/1970 | Seigle | 425/256 |
| 3,522,336 | 7/1970 | Piper et al. | 425/258 |
| 3,604,075 | 9/1971 | Locke et al. | 425/167 |
| 3,669,402 | 6/1972 | Paulson | 425/441 |
| 3,961,874 | 6/1976 | Balhorn | 425/421 |

FOREIGN PATENT DOCUMENTS

| | | | |
|---|---|---|---|
| 2,109,211 | 9/1972 | Germany | 425/455 |

*Primary Examiner*—Francis S. Husar
*Assistant Examiner*—John McQuade
*Attorney, Agent, or Firm*—Theodore J. Long; Harry C. Engstrom

[57] ABSTRACT

Fluid concrete is provided to apparatus which shapes the concrete into a desired form and may stack the finished products for removal by an operator. A concrete receiving portion of the apparatus holds the fluid concrete and discharges selected amounts thereof into a vertically open mold. The mold and the fluid concrete therein are supported during filling by a forming table. A compaction member is inserted into the mold to distribute and compact the fluid concrete therein, after which the mold may be removed from the table and held for vertical movememt by a mold carrier. Withdrawable support plates at the bottom of the mold support the shaped product therein after the mold has been removed from the forming table, with these support plates being selectively withdrawn to allow release of the shaped product from the bottom of the mold. A shaped product stacker is provided beneath the mold in position to receive shaped products released therefrom, and to stack a plurality of such products. A mode is provided wherein the concrete products may be shaped and stacked automatically.

34 Claims, 19 Drawing Figures

APPARATUS FOR PRODUCING SHAPED CONCRETE PRODUCTS

BACKGROUND OF THE INVENTION

1. Field of the Invention

This invention pertains generally to the field of apparatus for forming concrete into various shaped products and for handling such products.

2. Description of the Prior Art

Shaped concrete products are typically formed by pouring fluid concrete into an open mold having the form of the desired product, and allowing the concrete to set and harden within the mold. Such molds are generally made to collapse or expand away from the hardened concrete product to allow removal of the product from the mold. The pouring of the fluid concrete into the mold, distribution and tamping of the fluid concrete within the mold, and the removal of the hardened product from the mold has generally been a time consuming and expensive process requiring substantial labor. Moreover, a large number of molds must be utilized in order to produce a plurality of finished products at the same time, thus requiring a large investment in molds or resulting in slowed production because of the unavailability of sufficient molds.

A variety of cast concrete products are utilized which are of standardized shapes and are utilized in applications which do not require very high load carrying capabilities. For such applications, various types of quick-setting concrete may be utilized, with such concrete having the characteristic of being relatively stiff in its fluid form and capable of being compacted to a coherent mass which has substantial structural stability. A number of standardized products may be made from such quick-setting concrete, including such products as manhole riser adjustment rings, concrete catch basins and cisterns, and various types of pre-cast concrete block, as well as other, non-standardized products.

SUMMARY OF THE INVENTION

We have invented apparatus for producing shaped concrete products rapidly and efficiently, and with a minimum of direct labor. Quick setting fluid concrete provided to our apparatus is compacted and molded to a desired shape and may be stacked by our apparatus for removal and subsequent curing. The substantial compaction of the fluid concrete in our apparatus allows production of a product which has sufficient structural integrity to retain its shape after release from the mold, and may also be of sufficient structural rigidity to be stacked vertically without the need for side supports. An automatic mode is provided in our apparatus which automatically feeds fluid concrete, compacts the concrete within a mold, and stacks the finished product.

Our apparatus includes a concrete feeding portion which provides a means for feeding a selected amount of fluid concrete to a mold. The feeding portion includes a hopper for holding the fluid concrete and a conveyor running beneath the hopper which receives concrete from the hopper and delivers it at a controlled rate to an extendable concrete chute. The fluid concrete is guided by the chute into a vertically open mold which has inner and outer form walls which define the vertical shape of the desired finished product. The mold rests upon a flat forming table which supports and retains the fluid concrete within the mold during the filling operation. The forming table itself forms a portion of a horizontally movable carriage, which rides on horizontally disposed rails which form a portion of the frame of the apparatus.

The carriage moves the mold into a filling position beneath the horizontally extended chute such that fluid concrete passing off of the concrete conveyor will be guided into the space between the form walls of the mold. The table may be rotated during the filling operation where a circular type of mold is being utilized for circular products such as manhole adjustment rings.

After the mold has been filled with fluid concrete, the carriage, with the mold supported thereon, moves horizontally from the filling position of the mold to a forming position. In the forming position of the mold and carriage, the mold is disposed vertically beneath a mold carrier which can be utilized to releasably grasp the mold and provide vertical support thereto independent of the forming table. The mold carrier is moved vertically by a hydraulic drive unit which is attached to a tower portion of the frame of our apparatus. The carrier is also guided and stabilized by vertical side bars which are mounted to the sides of the frame tower, and to which the mold carrier is slidably attached. The mold carrier preferably grasps the mold by means of horizontally movable grasping fingers which are positioned to fit into notches which are formed in the top of the inner and outer form walls of the mold with the notches preferably being hook shaped to form a horizontally disposed slot. When the grasping fingers are moved horizontally to slip into the horizontally disposed slots, the entire mold may be moved vertically upward with the mold carrier. The forming table and carriage may then be moved vertically away from the working position to a position where it will not interfere with vertical movement of the mold.

A compaction member is provided which is vertically movable above said mold, preferably by being mounted to the mold carrier, and is shaped and positioned to be inserted into and fit closely within the inner and outer form walls of the mold beneath the grasping fingers. When the mold is in its forming position with fluid concrete therein, the mold carrier, with the compaction ring mounted thereto, may descend until the grasping fingers engage the notches in the mold and the compaction member makes contact with the fluid concrete held within the form walls of the mold. The grasping fingers are engaged with the notches in the walls of the mold to restrain the mold from undue movement during compaction. The compaction member is preferably mounted to the mold carrier to allow limited vertical movement independently of the grasping fingers, and applies substantial pressure on the fluid concrete within the mold by the weight of the compaction member and associated structure. A vibrator may be attached to the supporting members of the compaction member, with the vibration transmitted to the compaction member to thoroughly compact and distribute the fluid product within the mold. After compaction, the mold carrier elevates the mold away from the forming table, and the carriage moves the table away from the working area to a position where it will not interfere with vertical movement of the mold. Vertical support means for the formed product within the mold is provided by support plates which, in their extended position, extend from the inner wall of the mold partially into the space between the inner and outer form walls of the mold underneath the formed concrete product. The carrier may then descend with the mold and the shaped product therein until the bottom of the support plates and the product engage with the top of horizontally extending support members of a finished product stacker, or with finished products that are already stacked on the support members. The finished product stacker preferably consists of a vertically movable rack, having the support members extending therefrom, mounted on each side of the tower portion of the frame for coordinated vertical movements, with a central space preferably being left between the support members to allow a forklift or a similar loading machine to engage and support the finished products for transport to a location where the product can fully harden.

A mode of operation is provided wherein our apparatus can produce shaped concrete products automatically, with the fluid concrete that is provided to the hopper being continuously formed into shaped products, with the shaped products being stacked on the stacker in position to be removed by an operator for final curing. Alternatively, the various steps in the production of a shaped concrete product may be controlled manually by an operator.

Further objects, features, and advantages will be apparent from the following detailed description taken in conjunction with the accompanying drawings showing a preferred embodiment of an apparatus for producing shaped concrete products exemplifying the principles of our invention.

DESCRIPTION OF THE PREFERRED EMBODIMENTS

Figure 1:
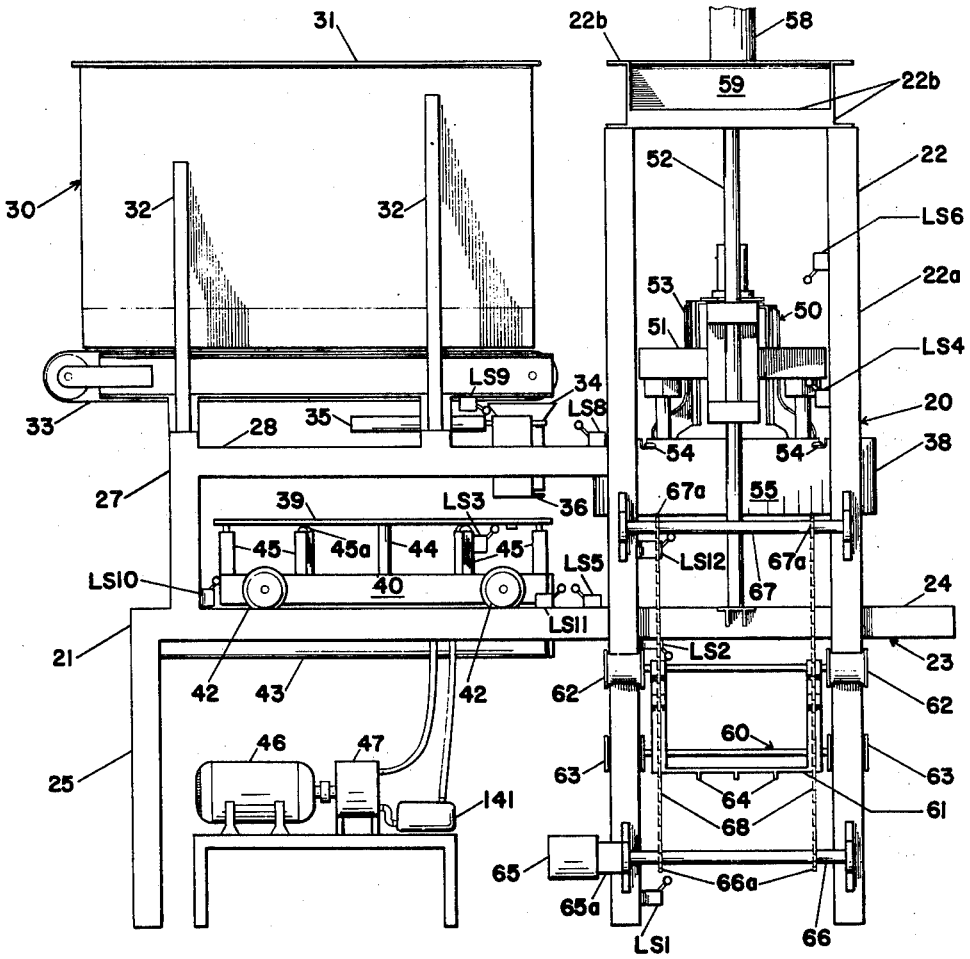
FIG. 1 is a side elevation view of our concrete product forming apparatus.

Referring now more particularly to the drawings, wherein like numerals refer to like parts throughout the several views, a preferred embodiment of our apparatus for producing shaped concrete products is shown generally at 20 in FIG. 1. The apparatus 20 has a support frame 21 which supports the operating portions of the apparatus. The support frame 21 has a generally vertically disposed tower portion 22 with four vertically disposed side members **22*a* which are arranged to form a generally rectangular tower. Top members 22*b*** connect the four vertically disposed side members at the tops thereof to form a rigid structure.

The frame 21 also has a horizontally extending portion 23 which includes a pair of side rails 24, which are rigidly attached for support to the vertically disposed side members **22*a* and to a pair of vertical posts 25 at one of the ends of the side rails 24. As best shown in the isometric view of FIG. 6, which shows our apparatus which with portions thereof removed for clarity, a transverse connecting member 26 is rigidly connected to the side rails at the ends thereof which are opposite the ends at which the vertical posts 25 are connected to the side rails. The connecting member 26 provides additional transverse structural rigidity to the horizontal portion of the frame. The horizontal portion 23 of the frame also includes a pair of vertical members 27 which are attached to and extend upwardly from the side rails 24, and horizontal members 28 attached to the ends of the vertical members 27 and extending to and attached to the vertically disposed side members 22*a*. Cross members 29 are attached to and extend transversely between the horizontal members 28 to provide a support framework for a concrete feeding portion of our apparatus shown generally at 30 in FIGS. 1 and 4–6. The concrete feeding portion 30 has a large hopper 31 for holding fluid concrete, which is supported by vertical struts 32 which are attached to and extend vertically from the cross members 29 to attachment with the hopper 31. The concrete feeding portion 30 also includes an endless belt conveyor 33, which is supported on the cross members 29 beneath the bottom of the hopper 31 and in position to receive fluid concrete by gravity from the bottom of the hopper. The conveyor 33 is driven by an electric motor (not shown in FIG. 1) at a controlled rate to deliver fluid concrete from the hopper to an extendable concrete chute 34 when the chute is in its extended position. The chute 34 is shown in its retracted position in FIG. 1 and in its extended position in FIG. 5. A hydraulic cylinder-piston unit 35 is responsive to hydraulic fluid under pressure supplied thereto to extend and retract the concrete chute 34. A shelf 36 is mounted beneath the retracted position of the chute 34 to catch any excess concrete material retained in the chute when the chute is retracted, while allowing this excess material to be swept off of the shelf 36** when the chute is extended to its filling position.

Figure 4:
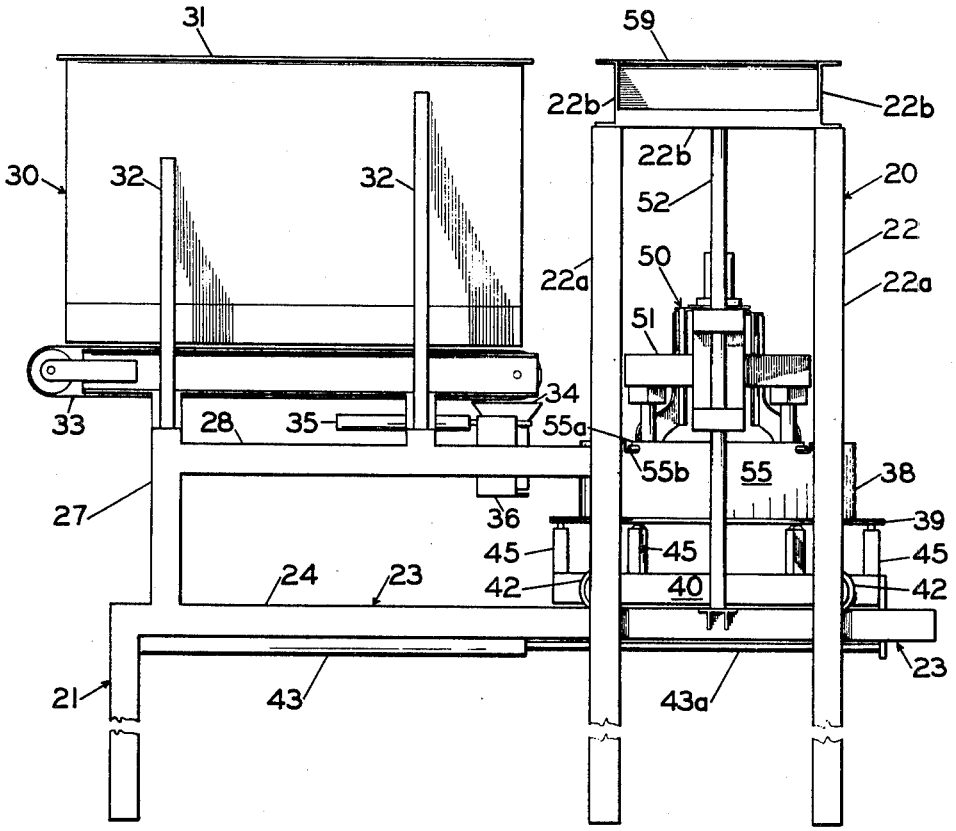
FIG. 4 is a somewhat simplified side view of the apparatus of FIG. 1, with the apparatus being shown in position to compact concrete within the mold.
Figure 5:
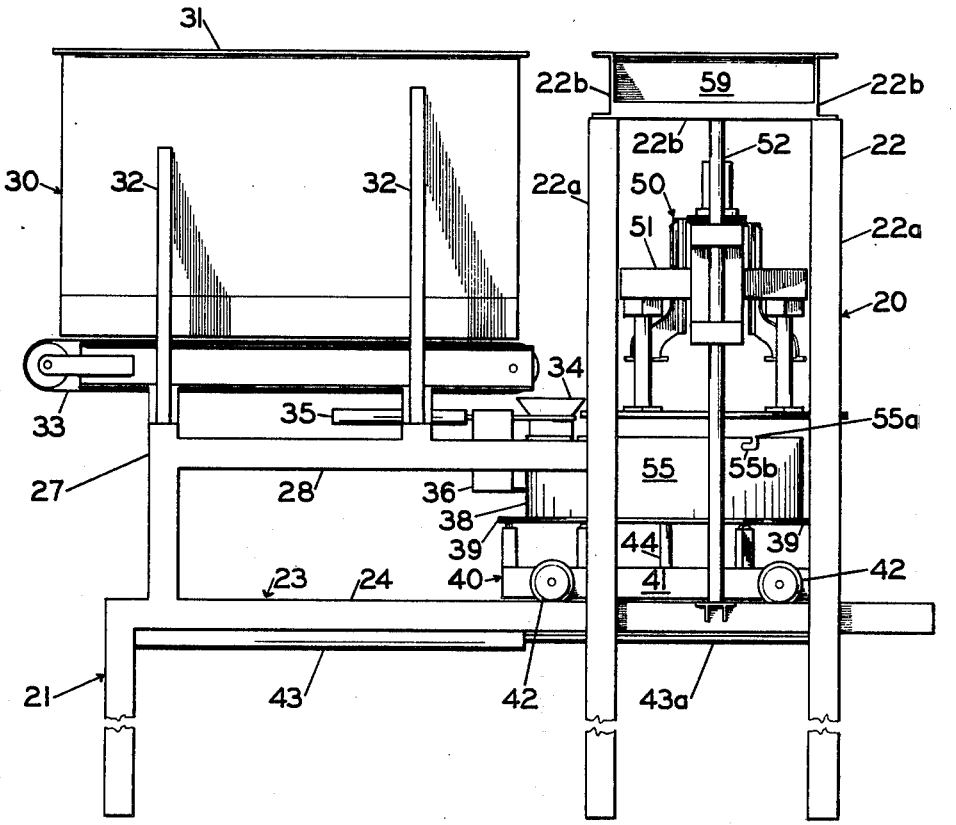
FIG. 5 is a somewhat simplified side elevation view of the apparatus of FIG. 1, the apparatus being shown in position to load fluid concrete into the mold.

The chute 34 is shown in its extended position in FIG. 5 in position to guide fluid concrete delivered by the conveyor 33 to be discharged therefrom into a vertically open mold 38. The mold 38 is shown in FIGS. 4 and 5 supported by a flat surfaced forming table 39 portion of a carriage 40. The carriage 40 has a generally rectangular frame 41, with wheels 42 mounted at the sides of the frame 41 which ride on the side rails 24 of the support frame 21. The carriage 40 is thus capable of horizontal rolling motion along the side rails. A hydraulic cylinder-piston unit 43 is attached to the frame 21 and has the movable plunger **43*a* thereof attached to the carriage 40. The cylinder-piston unit 43 is responsive to hydraulic fluid under pressure supplied thereto to drive the carriage between a series of positions, from fully extended wherein the mold 38 is centered in the tower portion 22 of the frame, to a partially retracted position or filling position wherein the mold is in position to be filled by concrete flowing through the chute 34 when the chute is in its extended position as shown in FIG. 5, to a fully retracted position as shown in FIG. 4. The carriage frame 41 supports the table 39 for rotational movement by a shaft 44 which is fixedly attached to the center of the preferably circular table 39, and extends downwardly therefrom to be journalled to the frame 41. A series of vertical supports 45 extend upward from attachment with the frame 41 of the carriage, and are provided with small vertically oriented wheels 45***a* at the top thereof which are journalled for rotational movement to the support 45 and which rollingly support the bottom of the table 39 near the outer edges thereof. The hydraulic fluid under pressure required to operate the respective cylinder-piston units is provided by an electric motor 46 driving a hydraulic pump 47, as shown in FIG. 1.

The mold 38 is selectively supported for vertical movement within the tower 22 by means of a mold carrier shown generally at 50 in FIG. 1. The mold carrier 50 has a carrier frame 51 which is slidably attached to vertical slide bars 52 which are mounted on each side of the side rails 24. The mold carrier 50 also has a mold grasping portion 53 thereof which includes a plurality of horizontally extending grasping fingers 54 which are adapted to be inserted into notches in the outer form wall 55 and the inner form wall 56 of the mold 38 to provide firm vertical support for the mold. The operation of the grasping fingers and the engagement with the mold will be explained in greater detail below.

The mold carrier 50 is driven in up-and-down vertical movement by a cylinder-piston unit 58 which is mounted by means of side braces 59 to the top of the tower 22. The plunger 58*a* of the cylinder-piston unit extends downwardly into engagement with the mold carrier 50, and the cylinder-piston unit 58 is responsive to hydraulic fluid provided thereto under pressure to selectively move the mold carrier in up-and-down vertical movement to selected vertical positions.

Figure 6:
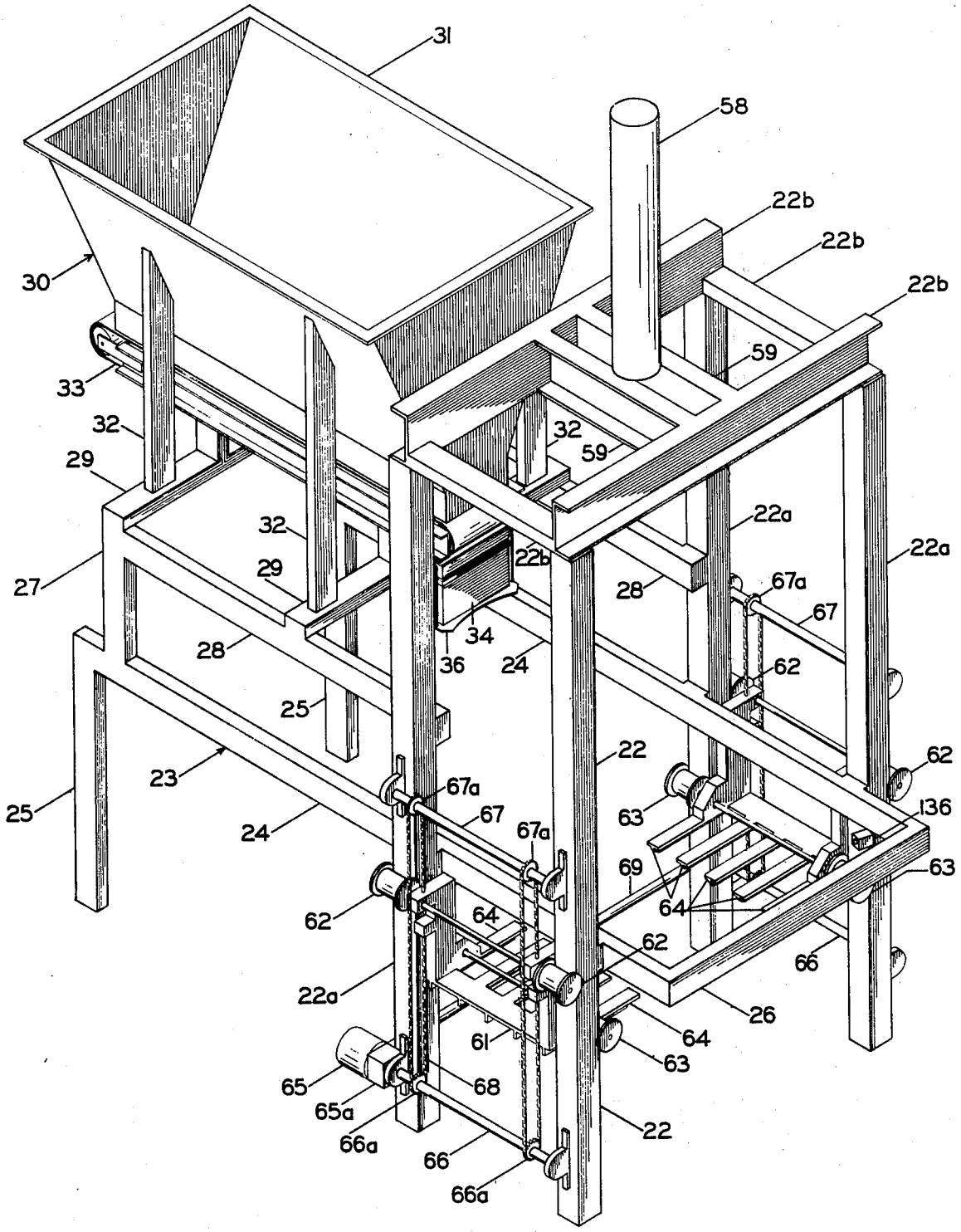
FIG. 6 is an isometric view of the apparatus of FIG. 1, with parts thereof removed to clarify the operation of the remainder of the apparatus.

Our apparatus for producing shaped concrete products also has a shaped product support and stacker portion shown generally at 60 in FIG. 1. The shaped product support and stacker 60 includes a pair of support racks 61 mounted on either side of the tower portion 22 of the frame. The racks 61 are each rollingly engaged with the vertical members 22*a* of the frame by means of a first pair of rollers 62 which are journalled to the rack 61 and are in rolling engagement with the outside surfaces of the vertical members 22*a*, and a second pair of rollers 63 which are in rolling engagement with the inside surfaces of the vertical members 22*a* and are also journalled to the rack 61, but at a lower level than the position of the rollers 62. Each rack 61 has a plurality of horizontally extending support members 64 which extend toward each other partially across the interior of the tower portion 22 of the frame 21. The racks 61 are driven in up-and-down movement by an electric motor 65 which is directly connected to one of a pair of shafts 66. The shafts 66 are mounted for rotational movement to the vertical side members 22*a* on opposite sides of the tower portion 22. Each shaft 66 has a pair of spur gears 66*a* affixed thereto, with a second similar shaft 67 being mounted on each side of the tower at a position above the shaft 66 for rotational movement to the side members 22*a*, with the shafts 67 having spur gears 67*a* thereon positioned directly above the spur gears 66*a*. Chains 68 are passed around each of the spur gears 66*a* and 67*a*, with the ends of the chains 68 being connected to the racks 61, as best shown in FIG. 6. A drive shaft 69 is connected through a bevelled gear within a housing 65*a* to the electric motor 65, with the shaft 69 being connected at the opposite end of the tower 22 to another bevelled gear (not shown) which is connected to the shaft 66 at the other side of the tower 22. Thus, rotation of the motor 65 will rotate both of the shafts 66, and will cause the chains 68 to draw the racks 61 up or down depending on the direction of rotation of the shaft 66. The support racks 61 on either side of the tower portion 22 of the frame are thus driven synchronously in up-and-down movement by the motor 65. The support members 64 of the racks 61 on the finished products stacker are positioned to receive and support compacted and shaped concrete products which are expelled from the open bottom of the mold 38, with the vertical position of the racks 61 being selected to allow stacking of multiple finished products before the products must be removed from the machine by an operator. Because the support members 64 on each of the racks 61 are preferably spaced laterally away from each other, an operator may insert a pallet truck between the racks to remove the stacked finished product, or the finished product may be removed by means of a forklift which is inserted between the ends of the support members.

Figure 7:
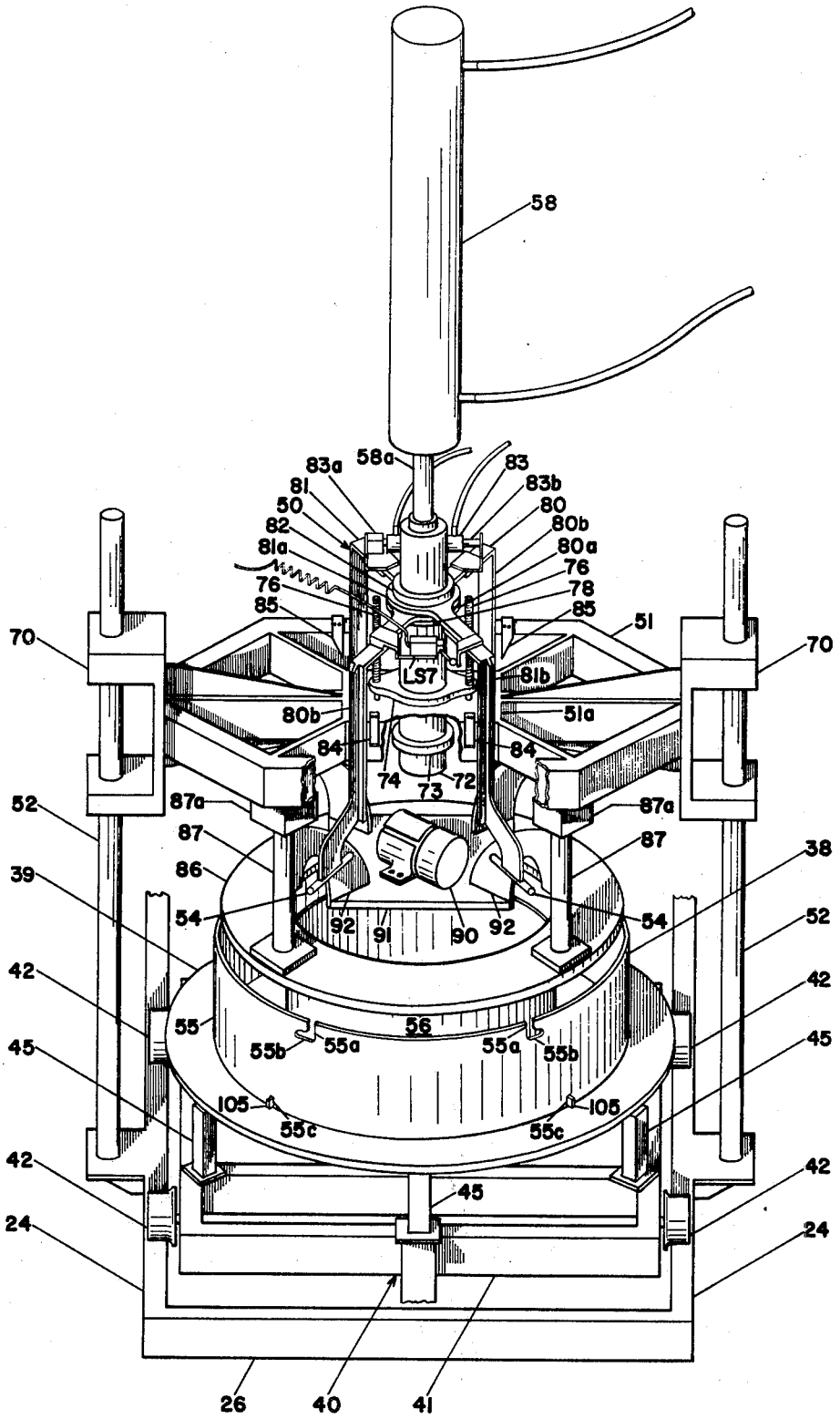
FIG. 7 is a frontal isometric view of a portion of the apparatus of FIG. 1.

The operation of the mold carrier 50 in conjunction with the mold 38 is best shown with reference to FIG. 7. The mold 38 is shown in FIG. 7 supported on the table 39 of the carriage 40, with the mold carrier 50 positioned vertically above the mold 38. As indicated above, the mold carrier 50 has a carrier frame 51 which has bearing mounts 70 attached to either end of the carrier frame 51. The bearing mounts 70 are slidingly mounted by sliding bushings (not shown) to the vertical slide bars 52. The mounting of the carrier frame 51 to the pair of slide bars 52 provides horizontal stability for the carrier frame 51 and for the remainder of the mold carrier. The plunger 58*a* of the cylinder piston unit 58 is rigidly attached to a central core shaft 72 which is preferably of larger diameter than the plunger shaft 56*a*. The central core shaft 72 is passed through an opening (not shown) in a central box portion 51*a* of the carrier frame 51. The central core shaft 72 is not rigidly connected to the carrier frame 51 and thus limited vertical up-and-down movement of the central core shaft with respect to the carrier frame is allowed. An adjustable collar 73 is mounted to the central core shaft 72 at a position below the opening in the central box portion of the carrier frame 51 as shown in the partial cut-away view of FIG. 7. Upward movement of the central core shaft 72 eventually brings the adjustable collar 73 into contact with the underside of the central box portion 51*a*, and further upward movement of the central core shaft 72 will draw the carrier frame 51 along therewith. A winged collar 74 is attached to the central core shaft 72 at a selected position above the opening in the central box portion 51*a* of the carrier frame through which the central core shaft passes. A pair of vertical rods 75 extend upwardly from the top of the central box portion 51*a* of the mold carrier through openings in the extending portions of the winged collar 74. The rods 75 may move freely within the opening in the winged collar 74 but are connected to the collar 74 by means of a pair of springs 76, with a spring 76 being attached at one end thereof to the top of a vertical rod 75 and at the other end thereof being attached to the winged collar 74. Thus, when the central core shaft 72 is drawn upwards by the cylinder piston unit 58, the winged collar 74 moves upwardly with respect to the central box portion 51*a* of the carrier frame and the springs 76 are compressed. The compression of the springs 76 provides a downward push on the carrier frame 51 for the reasons explained below.

Figure 8:
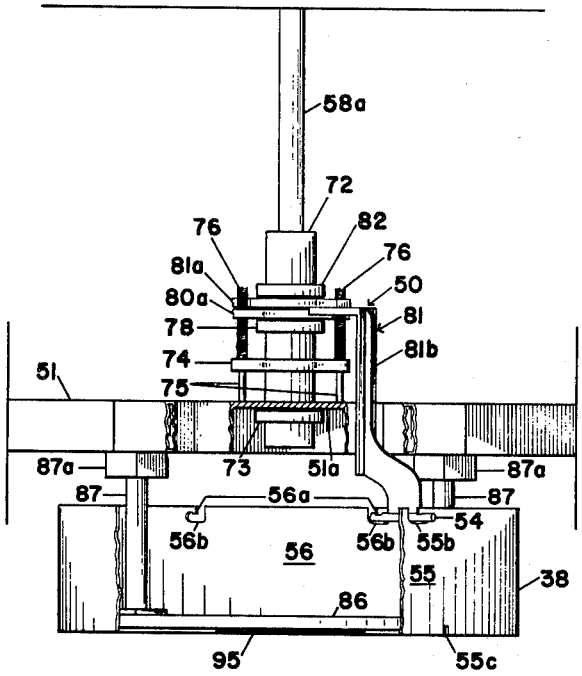
FIGS. 8–10 are elevation views of the mold carrier and mold portions of the apparatus of FIG. 1 showing their relationship during the operation of our apparatus, with portions thereof being broken away for purposes of illustration.
Figure 10:
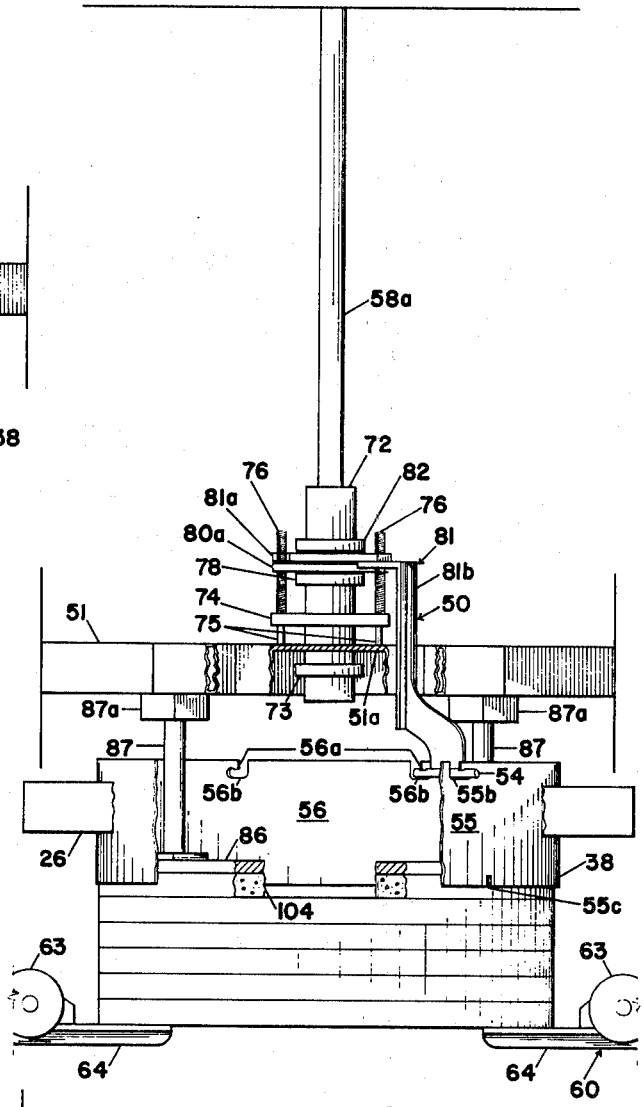
Figure 9:
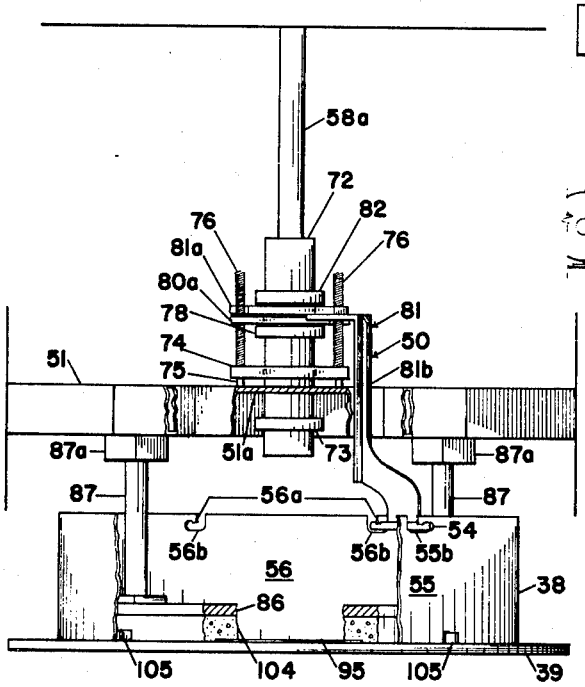

An adjustable collar 78 provides upward vertical support to a first pick-up arm unit 80 and a second pick-up arm unit 81. A second adjustable collar 82 is mounted to the central core shaft 72 just above the second pick-up arm unit 81 such that the pick-up arm units 80 and 81 are loosely restrained between the adjustable collar 78 and the adjustable collar 82. The first pick-up arm unit 80 has a collar portion 80*a* having a central opening therein through which the central core shaft is passed, with the central collar portion 80*a* of the unit 80 being freely movable in rotational movement about the central shaft 72. The pick-up arm unit 80 also includes a pair of descending pick-up arm members 80*b*, with the arm members 80*b* being attached at the tops thereof to the ends of the central collar portion 80*a* and descending therefrom through the spaces between the structural members of the carrier frame 51. A horizontally extending grasping finger 54 is fixedly attached to the lower end of each of the descending pick-up arm members 80*b*. As shown in FIG. 7, the descending arm members 80*b* preferably have a portion thereof which extends outwardly as well as downwardly to attachment with the grasping fingers 54 where appropriate to provide proper placement of the grasping fingers above the mold 38, with the position of the grasping fingers being determined to adapt to the size and shape of the mold utilized. The second pick-up arm unit 81 is mounted above the pick-up arm unit 80 and also has a central collar portion 81*a* with an opening therein, allowing the central core shaft 72 to be passed therethrough, with the central collar portion 81*a* being mounted thereon for rotational movement. The pick-up arm 81 also has a pair of descending pick-up arm members 81*b* which extend downwardly and outwardly as shown in FIG. 7 to attachment to the horizontally extending grasping fingers 54. The grasping fingers 54 are adapted to fit into hooked notches 55*a* in the outer form wall 55 of the mold 38 and into similar hooked notches 56*a*, as best shown in FIGS. 8–10, in the inner form wall 56 of the mold. The notches 55*a* are hook shaped in that they descend downwardly to a horizontally disposed slot 55*b*. The notches 55*a* similarly descend downwardly to a horizontally disposed slot 56*b*. The grasping fingers 54 are positioned normally to descend and fit into the openings of the notches 55*a* and 56*a*, such that when the grasping fingers reach the bottom of the notches 55*a* and 56*a*, they may be moved horizontally into the slot portion 55*b* and 56*b* of the notches such that upward movement of the grasping fingers will cause them to engage the portion of the form walls 55 and 56 that overhang the slots 55*b* and 56*b*, thus drawing the entire mold 38 upwardly along with the grasping fingers. The first pick-up arm unit 80 and the second pick-up arm unit 81 are moved apart, to cause the grasping fingers 54 to move horizontally and be inserted in the slot portions of the notches, by means of a hydraulic cylinder-piston unit 83 which has the cylinder portion 83*a* of the unit mounted to the second pick-up arm unit 81 and the plunger 83*b* of the cylinder-piston unit mounted at the other end to the first pick-up arm unit 80. When the grasping fingers 54 are in their engaged position in the slots 55*b* and 56*b*, the mold 38 may be moved upwardly and downwardly by the cylinder-piston unit 56. When the mold is to be released onto the table 39, hydraulic fluid under pressure may be provided to the cylinder-piston unit 83 to cause the plunger 83*b* to be withdrawn into the cylinder portion 83*a*, thus moving the grasping fingers horizontally out of the slots 55*b* and 56*b*. The inward motion of the grasping fingers is controlled by a limit switch LS7, which is mounted between the pick-up arm units 80 and 81, such that sufficient inward horizontal motion of the pick-up arm units will cause the limit switch LS7 to trip and shut off the hydraulic fluid under pressure being supplied to the hydraulic cylinder-piston unit 83. Inward motion of the grasping fingers may also be limited by detent members 84, mounted to the central box portion 51*a* of the carrier frame, which are engaged by the descending arm members 80*b* and 81*b*. Outward motion of the grasping fingers may also be checked by detent members 85 which are mounted to the carrier frame 51. When the grasping fingers 54 have been moved to their inward position, the mold carrier may then be moved up by the cylinder-piston unit 58 out of engagement with the mold 38.

The fluid concrete that is deposited in the mold 38 may be unevenly distributed within the mold, and there may be air pockets within the fluid concrete. Loose packing of the concrete in the finished product, and the presence of air pockets therein, is undesirable since such defects would greatly weaken the structural integrity of the finished product. In order to fully pack the fluid concrete within the form 38 and to provide a smooth upper and lower surface for the finished concrete product, we have provided a compaction member 86 which is shaped and sized to fit closely within the vertically open mold 38 such that the compaction member 86 may descend into the mold between the inner and outer form walls to press upon and compact the fluid concrete contained therein. For the circular mold shown for illustrative purposes in FIG. 7, the compaction member 86 is shown illustratively in the form of a ring. The compaction member 86 is preferably mounted to the frame 51 of the carrier 50, although it is apparent that the compaction member 86 could be separately supported and mounted for vertical movement apart from the mold carrier 50. As shown in FIG. 7, the compaction member 86 is suspended from the frame 51 of the mold carrier by a plurality of vertical pillars 87 which are rigidly affixed to the carrier frame 51 at their top ends and are also rigidly affixed to the compaction member 86 at their bottom ends. The compaction member 86 is thus rigidly connected to the carrier frame 51 and exactly follows the movement of the frame. As the cylinder-piston unit 58 moves the carrier frame 51 downwardly, the compaction member 86 will be inserted into the vertically open mold 38 and will eventually come into contact with the fluid concrete within the mold. The downward vertical travel of the carrier 51 is controlled by the tripping of a limit switch (not shown in FIG. 7) such that the mold carrier will stop descending where the grasping fingers 54 have been inserted into the notches 55*a* and 56*a* in the form walls of the mold. Since the carrier frame 51, with the compaction member 86 mounted thereto, is capable of a limited vertical movement with respect to the remainder of the mold carrier, the compaction pressure on the fluid concrete is primarily due to the weight of the compaction member itself and the mold carrier frame 51, without the aid of additional pressure provided by the hydraulic cylinder-piston unit 58.

We have determined that the compaction and distribution of the fluid concrete within the mold 38 may be greatly enhanced by applying strong vibrational forces to the fluid concrete during compaction, with the vibrations preferably being delivered to the fluid concrete through the compaction member 86. The vibration of the compaction ring 86 is preferably accomplished in our apparatus with an electrical motor vibrator 90 which is rigidly attached to a suspended table 91, with the table 91 being attached to struts 92 which extend to and are attached to the vertical pillars 87. Thus, activation of the motor-vibrator 90 causes vibrations to be transmitted via the table 91 through the struts 92 to the vertical pillars 87, with the major portion of the vibrations on the pillars 87 being transmitted to the compaction ring 86. Since the compaction ring 86 is suspended, it will experience greater amplitude of vibrations than will the firmly mounted carrier frame 51 to which the pillars 87 are attached at the tops thereof. If desired, the transmission of vibrations to the carrier frame 51 may be further reduced by providing a rubber gasket, or equivalent vibration dampening gasket, at the mounting 87*a* of the pillars to the carrier frame 51.

APPARATUS OPERATING POSITIONS

The basic operating positions of our apparatus 20 are shown in FIGS. 1, 4 and 5. FIG. 5 shows the loading position of the apparatus wherein the carriage 40 and forming table 39 provide vertical support to the mold 38, and the mold 38 is moved by the carriage 40 to a position where it can receive fluid concrete discharged from the end of the conveyor 33. The extendable chute 34 is shown in FIG. 5 in its extended position to guide the fluid concrete flowing off the end of the conveyor 33 by gravity into the mold 38. The table 39 rotates during the filling operation to allow all portions of the mold to be provided with a uniform amount of concrete. The apparatus 20 is shown in FIG. 4 in the compaction position wherein the compaction member 86 abuts against the fluid concrete within the mold 38 to apply pressure thereto and to allow the mechanical vibrations provided by the vibrator 90 to be transmitted through the compaction member 86 to the concrete to evenly distribute and fully compact the concrete within the mold. The view of FIG. 1 shows the mold carrier 50 supporting the mold 38 and the compacted concrete therein. The carriage 40 is removed to a withdrawn position where it does not interfere with the vertical movement of the mold 38 and mold carrier 50. In this position, the mold carrier 50 can descend to a point where the bottom of the mold 38 abuts with the support members 64 of the stacker 60, or with a finished product which has already been stacked and supported on the stacker 60. The hydraulic fluid applied to the hydraulic cylinder-piston unit 58 is controlled by limit switches and electrical and hydraulic control means (not shown in FIG. 1) to cause the mold carrier to descend to a predetermined vertical unloading position within the towered portion 22. The stacker 60 is also controlled by control means (not shown in FIG. 1) to position the support members 64 at a level at which the top of the product supported on the stacker 60 will be adjacent to the bottom of the mold 38 in the unloading position. This is preferably accomplished by means of a photo electric sensor (not shown in FIG. 1) which senses when the stacker 60 has ascended to the point where the top of the top product supported by the stacker 60 is at the desired level.

Once the product within the mold 38 has been released therefrom, and is carried and supported by the stacker 60, the mold 38 is then carried upwardly by the mold carrier 50 to a vertical position wherein the bottom of the mold 38 does not obstruct the horizontal movement of the carriage 40 and the table 39. The carriage 40 is then moved into a position directly underneath the mold 38 and the mold is moved down by the mold carrier 50 until the mold is supported by the table 39, at which point the mold carrier 50 is controlled by control circuitry to release the mold for support by the table 39, thus allowing the mold to again be moved by the carriage 40 to its loading position shown in FIG. 5.

MOLD OPERATION

Figure 2:
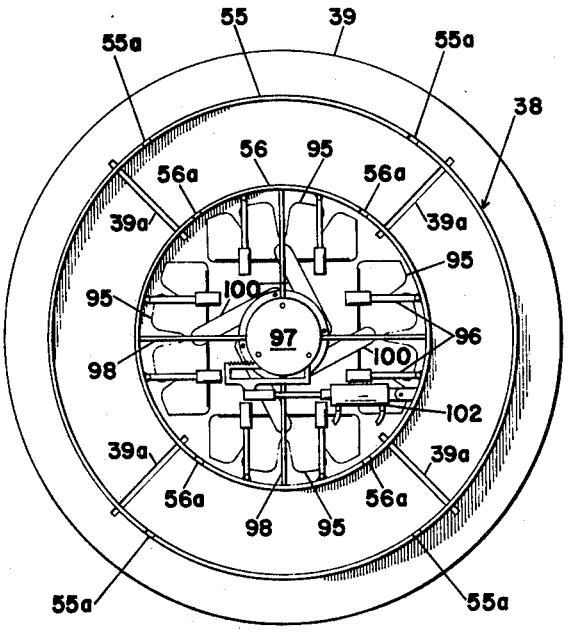
FIG. 2 is a top plan view of the mold portion of the apparatus of FIG. 1.
Figure 3:
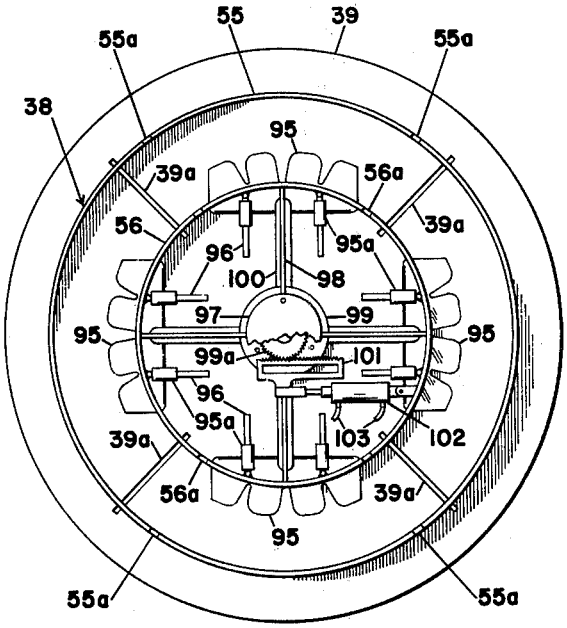
FIG. 3 is another top plan view of the mold portion of the apparatus of FIG. 1.

The construction and operation of the mold 38 is best shown with reference to FIGS. 2 and 3. As indicated above, the mold 38 consists of an outer form wall 55 and an inner form wall 56, with the space between the inner and outer form walls being vertically open both at the top and at the bottom of the mold. It is apparent that when the mold 38 is supported by the forming table 39, vertical support for the fluid concrete within the mold is provided by the top of the table 39. However, when the mold 38 is supported by the mold carrier 50, as shown in FIG. 1, the shaped product within the mold 38 must be held until the mold carrier 50 can lower the mold 38 into contact with the support members of the stacker 60 or with a finished product which is supported by the stacker 60. This vertical support of the shaped product within the mold 38 is provided by support plates 95 which are shown in their extended position in FIG. 3, extending outwardly into the open space between the inner form wall 55 and the outer form wall 56 at the bottom of the mold 38. Each of the support plates 95 preferably consists of a flat relatively thin metal plate which is mounted for sliding horizontal movement by brackets 95*a* which fit over and slidingly engage horizontally extending rods 96 which are welded or otherwise affixed to the inner surface of the inner form 56. As shown in FIG. 3, the extended support plates 95 do not fully close the entire bottom of the mold 38 in the preferred embodiment shown therein, although it is apparent that the support plates 95 could be so constructed as to substantially cover the entire bottom of the mold 38 in their extended position and overlap one another slightly when in the withdrawn position. Such total closure of the entire bottom of the mold 38 is not necessary where suitably stiff and quick setting fluid concrete is utilized to form the shaped concrete products, since this type of concrete will have sufficient cohesiveness after it is formed and compacted to support itself in the open spaces between the support plates 95. The support plates 95 are preferably further scalloped as shown in FIGS. 2 and 3, to provide projecting portions which may more easily be withdrawn from the formed concrete, and which allow concrete to be impressed between the projecting portions at the level of the surrounding concrete.

A central hub 97 is rigidly attached to spoke members 98 which extend radially outward to attachment with the inner surface of the inner form wall 56. The spoke members 98 provide a rigid suspension of the central hub 97 above the bottom of the mold 38. A sprocket 99 is rotatably mounted to the underside of the central hub 97, and, as best shown in FIG. 3 in which a portion of the hub 97 is broken away, the sprocket has a spur gear portion 99*a* formed as a part thereof on the upper side of the sprocket 99, the spur gear portion 99*a* and the lower side of the central hub 97. The sprocket 99 has four connecting rods 100 which are pinioned to the periphery of the sprocket at one end of the connecting rods, with the other ends of the connecting rods 100 each being pinioned to one of the support plates 95. A straight gear rack 101 has the teeth thereof in engagement with the teeth of the spur gear 99*a* on the sprocket 99, with the gear rack 101 being connected to a hydraulic cylinder-piston unit 102 which is rigidly mounted to the inner surface of the inner form wall 56. The gear rack 101 is shown in its inward position in FIG. 3, wherein the support plates 95 are extended into the area between the inner form wall 55 and the outer form wall 56. When hydraulic fluid is supplied to the hydraulic piston-cylinder unit 102 to drive the gear rack 101 outwardly, the gear rack 101 turns the spur gear of the sprocket 99 which causes the sprocket to turn in a counterclockwise direction, thus drawing the connecting rods 100 along with the sprocket and withdrawing the support plates 95 to their withdrawn position shown in FIG. 2. When the support plates are in this withdrawn position, the formed concrete product within the mold 38 may be released therefrom through the bottom end of the mold, and thereafter supported by the stacked products carried by the stacker 60. After the shaped concrete product has been released from the mold 38, the cylinder-piston unit 102 may be supplied with hydraulic fluid under pressure in the opposite direction to withdraw the gear rack 100 toward the cylinder-piston unit 102, turning the sprocket 99 in a counterclockwise direction, and extending the support plates 95 into the space between the inner and outer form walls. The mold 38 would thus be in position to receive a new charge of concrete to be compacted and shaped. The hydraulic cylinder-piston unit 102 is supplied with hydraulic fluid under pressure by flexible hydraulic hoses 103, a portion thereof being shown for illustrative purposes in FIGS. 2 and 3. The hydraulic hoses 103 extend upwardly to the mold carrier 50, and are of sufficient length and flexibility to allow the mold 38 to be moved between its loading and compacting positions and to the release position of the mold where the finished product is released to the stacker 60.

It is apparent that the support plates could be extended and withdrawn by other means. For example, a hand operated wheel could be attached to the sprocket 99 such that the sprocket could be rotated by turning the hand wheel. Such manual operation would allow the entire mold with concrete therein to be removed from the rest of the apparatus, and stored during curing of the concrete.

OPERATION OF THE MOLD CARRIER

The sequence of operations of the mold carrier 50 is best illustrated with reference to FIGS. 8–10. The views of FIGS. 8–10 are partial fragmented views of the mold carrier 50, with parts thereof broken away, in position to hold and carry the mold 38, with the mold 38 also being shown with parts thereof broken away. The position of the mold carrier 50 and mold 38 in FIG. 8 is an initial position in which no shaped concrete product is carried in the mold 38, such as would be the case after the shaped product has been discharged from the mold when the mold carrier 50 is returning to its initial position. The pick-up arm units 80 and 81 are in engagement with the mold 38 and are carrying it by means of the grasping fingers 54. The carrier frame 51, with the compaction member 86 suspended therefrom, is engaged with and vertically held by the adjustable collar 73 which is in abutment with the bottom of the central box portion 51*a* of the carrier frame 51.

The compaction position of the mold carrier 50 is shown in FIG. 9. A portion of a concrete product 104 being shaped is shown contained within the mold 38 between the inner and outer form walls, and is provided vertical support from beneath by the forming table 39 and the support plates 95. The compaction member 86 rests on and presses upon the upper surface of the shaped concrete product 104. The pick-up arm units 80 and 81 have the grasping fingers 54 thereof in engagement with the mold 38 to hold the mold during the compaction process. However, the mold 38 is provided primary vertical support by the forming table 39. The mold carrier frame 51 is supported independently of the remainder of the mold carrier, since the compaction member 86 is in firm contact with the shaped concrete product 105, which is itself supported by the forming table 39. The carrier frame 51 is thus vertically held by the pillars 87 which extend upwardly from the compaction member 86. It is apparent that the carrier frame 51 has provided no vertical support by the central core 72, since the adjustable collar 73 is out of contact with the bottom of the central box portion 51*a* of the carrier frame. Vertical support of the shaped concrete product 104 is provided by the extended support plates 95 which are themselves mounted to the inner form wall 56, with both the inner form wall 56 and the outer form wall 55 being carried by the grasping fingers 54 of the mold carrier pick-up arm units 80 and 81. The compaction member 86 rests upon and is supported vertically by the shaped concrete product 104, with the carrier frame 51 being supported on the compaction member 86 through the vertical pillars 87, and the carrier frame 51 is ultimately provided vertical support in this position by the support plates 95. Upward and downward movement of the plunger 58*a* of the cylinder-piston unit 58 will thus move the entire mold carrier 50, the mold 38, and concrete product 104 therein in unison with it.

The release of a shaped concrete product from the mold 38 is shown in FIG. 10, which is a partial fragmented view of the mold carrier 50, with a portion thereof broken away, in engagement with the mold 38, with the mold 38 also being shown with a portion thereof being broken away. A portion of the finished product stacker 60 is also shown in FIG. 10 for illustrative purposes, wherein a stack of finished shaped concrete products is shown supported by the support members 64 of the stacker 60. As indicated above, when the bottom of the mold 38 is adjacent to the top of a previously stacked finished shaped concrete product, the support plates 95 are withdrawn into the inner form wall 58, thereby releasing the vertical support that had been provided to the product within the mold 38 by the support plates 95. The mold carrier 50 then is raised by the cylinder-piston unit 58, and the mold 38 held by the pick-up arm units 80 and 81 is raised therewith. However, the carrier frame 51 and the compaction member 86 suspended therefrom are not rigidly connected to the central core 72 of the mold carrier, and thus will not immediately move upwardly in response to the upward motion of the central core. The compaction member 86 will therefore continue to exert downward force on the shaped concrete product 104 within the mold 38, and will tend to force this product out of the bottom of the mold and in contact with the previously stacked finished products. The compaction member 86 remains substantially constant in position until the adjustable collar 73 comes into contact with the bottom of the mold carrier frame 51, at which point the mold carrier frame 51 is drawn upwardly with the central core 72. The springs 76 are connected at the lower ends thereof to the winged collar 74, which is itself rigidly attached to the central core 72, with the springs 76 being attached at their upper ends to the vertical rods 75 which are rigidly attached to the carrier frame 51. Thus, downward force is exerted by the somewhat compacted springs 76 through the rods 75 to the carrier frame 51 and thence to the compaction member 86 to aid the compaction member 86 in expelling the shaped concrete product out of the bottom of the mold 38. After the shaped product 104 is released from the mold 38, and the mold carrier has drawn the mold 38 upwardly, the stacker 60 lowers the stack of concrete products supported thereon until the top of the last shaped concrete product 104 is below a preselected vertical position at which point the stacker stops downward movement. The determination of the level at which the top of the last stacked product will be maintained is preferably accomplished by means of a photoelectric sensor and a light beam source in connection therewith (not shown in FIGS. 8–10) which allows a circuit to be controlled depending on whether there is an unbroken beam of light between the light source and the photoelectric sensor. After the stack has reached a height which does not allow additional shaped products to be placed thereon without interfering with the light sensor, the machine will preferably interupt its operation until an operator may remove the stack of shaped products from the stacker 60.

CARRIAGE AND FORMING TABLE OPERATION

Figure 11:
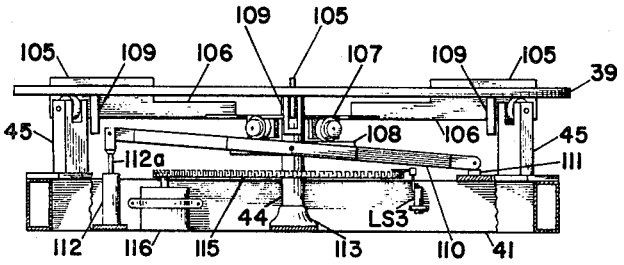
FIG. 11 is an elevation view of the forming table and a portion of the carriage of the apparatus of FIG. 1.

It is desirable to provide a reinforcing ring or other reinforcing structure, preferably formed of metal, within the shaped concrete product to enhance the structural stability of the product. The reinforcing ring or metal structure must be suspended above the surface of the forming table 39 while the fluid concrete is poured into the mold 38, and the fluid concrete must be formed and spread completely around the reinforcing material. To provide this support means for the reinforcing ring material, our apparatus 20 has spacer fingers 105 which selectively protrude through openings 39*a* in the forming table 39. The spacer fingers are shown in FIG. 11 in an extended position in which they protrude above the surface of the forming table 39. When the spacer fingers are fully raised, the reinforcing ring may be supported thereon and concrete may be poured into the mold to form around the reinforcing ring and the spacer fingers. After the mold has been filled, and before the step of compaction, the spacer fingers 105 are retracted to the level of the surface of the forming table or below so that the fluid concrete may be compacted around the reinforcing ring.

Variable height support for the spacer fingers 105 is provided by support arms 106 which are affixed at one end thereto to the spacer fingers 105, and have the other ends of the support arms affixed by welding or otherwise to a flat supporting member 106*a*. Four vertically disposed wheels 107 are mounted for rotational movement to the sides of the supporting member 106*a*. The bottoms of the wheels 107 are in rolling contact with a circular platform 108, with the wheels 107 rolling freely on the flat top surface of the platform 108 as the spacer fingers 105 and support arms 106 are rotated along with the table 39. The support arms 106 are held and guided by U-shaped members 109 which are welded or otherwise affixed to the bottom of the table 39, with the support arms 106 being vertically movable in the central opening of the U-shaped member 109, but being restrained from horizontal movement by the sides of the members 109.

Figure 12:
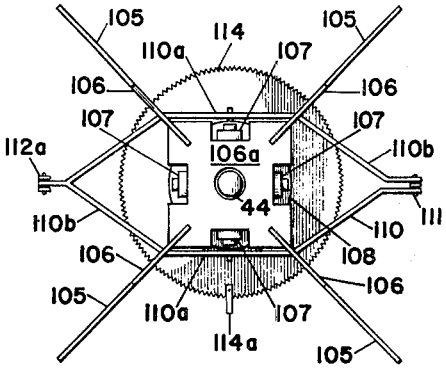
FIG. 12 is a top plan view of the spacer finger assembly of the apparatus of FIG. 1.

The circular platform 108 is journalled for rotational movement at opposite edges thereof to the sides of a yoke member 110. As best shown in FIG. 12, the yoke member 110 has substantially parallel side members 110*a* on either side of the circular platform 108, with the circular platform being journalled to the side members 110*a*. The side members 110*a* are integrally joined at each end thereof to forked members 110*b*. One of the forked members 110*b* is pinioned for rotational movement thereabout in a vertical plane to a support 111, which is itself mounted to the frame 41 of the carriage 40. The end of the forked member 110*b* at the opposite end of the yoke 110 is pinioned to the end of the plunger 112*a* of a hydraulic cylinder-piston unit 112, with the cylinder-piston unit 112 being mounted generally vertically to the carriage frame 41.

The circular platform 108 and the flat supporting member 106*a* both have openings in the central portion therein to allow the shaft 44 which supports the table 39 to pass therethrough without contact with either the supporting member 106*a* or the circular platform 108. It is apparent from the side view of FIG. 11 that upward motion of the plunger 112*a* of the cylinder-piston unit 112 will cause the yoke 110 to rotate slightly upwardly about the support 111, thus raising the circular platform 108 in a generally vertical plane. The wheels 107 will, of course, move upwardly with the circular platform 108 and will carry the support arms 106 and thus the spacer fingers 105 upwardly with them. The spacer fingers 105 can thus be extended up through the openings 39*a* in the table 39 to protrude a selected distance above the top of the table. It is preferable that the spacer fingers 105 extend up underneath both the inner form wall 57 and the outer form wall 55. Notches 55*c* are provided at the bottom of the form wall 55 to allow insertion of the spacer fingers 105 therein, with similar notches (not shown) being provided in the bottom of the inner form wall 56. Insertion of the spacer fingers into the notches in the form walls also aids in the proper alignment and positioning of the mold 38 on the table 39.

It is also apparent that the withdrawal of the plunger of the cylinder-piston unit 112 will cause the yoke 110 to rotate downwardly, thus allowing the support arms 106 and the spacer fingers 105 to be withdrawn downwardly. Downward withdrawal of the spacer fingers 105 may be aided if desired. For example, a hook shaped member (not shown) may be affixed to the supporting member 106*a* and extend downwardly therefrom through the opening in the circular platform 108, with the hook of the member being in position to engage the bottom surface of the circular platform 108 when the platform is moved downwardly by motion of the yoke 110. Alternatively, it is apparent that a spring could be interposed between the table 39 and the support member 106*a* to force the support member downwardly as the yoke 110 is rotated downwardly.

The mounting of the table 39 for rotation is best illustrated with reference to FIG. 11. The shaft 44, which is affixed to the bottom of the table 39 and supports it for rotational movement, is journalled at the bottom thereof to a bearing 113 which is rigidly mounted to the frame 41 of the carriage 40. A gear edged wheel 114 is rigidly affixed to the shaft 44 in a horizontal plane with the shaft 44 being at the center of the gear wheel 114. The gear wheel 114 is driven by a chain 115 which engages the gear teeth on the edge of the wheel, and which also engages a pinion (not shown) connected to the shaft of an electric drive motor 116 which is mounted to the carriage frame 41. When electricity is supplied to the electric motor 116 it will drive the table 39 in rotational movement, with the spacer fingers 105 moving in rotational movement therewith.

CONTROL OF APPARATUS OPERATIONS

The sequence of operations of our apparatus 20 is controlled by limit switches which sense the relative position of the various moving components. The positioning of these limit switches is shown illustratively in FIG. 1 such that each switch will be in approximately the proper position to be tripped when a corresponding moving component is in a selected position. Each of the limit switches shown in FIG. 1 may have a plurality of switch segments, with each switch segment being either normally open or normally closed.

With reference to FIG. 1, a first limit switch LS1 is positioned near the bottom of the tower portion 22 of the support frame, and is tripped when the product stacker 60 is at the desired bottom of its travel. A limit switch LS2 is mounted to the tower portion 22 in position to be tripped when the stacker 60 is at the desired top of its travel.

A limit switch LS3 is mounted to the carriage 40 in position to be tripped by a protrusion on the underside of the forming table 39 as the table completes a revolution. Alternatively, as shown in FIG. 3, the limit switch LS3 may be mounted on the carriage frame 41 in position to be tripped by a protruding member **114*a* attached to the gear wheel 114**.

A limit switch LS4 is positioned on the tower portion 22 to be tripped by the mold carrier 50 when the mold carrier is in the forming or compacting position. Another limit switch LS5 is mounted to the horizontally extending portion 23 of the support frame in position to be tripped by the carriage 40 when the carriage is in the forming position.

A limit switch LS6 is mounted to the tower portion 22 in position to be tripped by the mold carrier when the mold carrier has reached the upper limit of its desired travel.

With reference to FIG. 7, the limit switch LS7 is mounted between the pick-up arm units 80 and 81 and is tripped when the pick-up arm units are in their inward or release position.

A limit switch LS8 is mounted to the frame 21 in position to be tripped when the concrete chute 34 is in its extended or loading position, and another limit switch LS9 is mounted to the frame in position to be tripped when the chute is retracted.

A limit switch LS10 is mounted to the horizontally extending portion of the frame in position to be tripped when the carriage 40 is in its fully retracted position. The loading position of the carriage is sensed by a limit switch LS11 which is mounted to the frame such that it is tripped when the loading position is reached.

Another limit switch LS12 is attached to the tower portion 22 in position to be tripped by the mold carrier 50 when it is in its desired lowest position, where release of the shaped product from the mold occurs.

Figure 13:
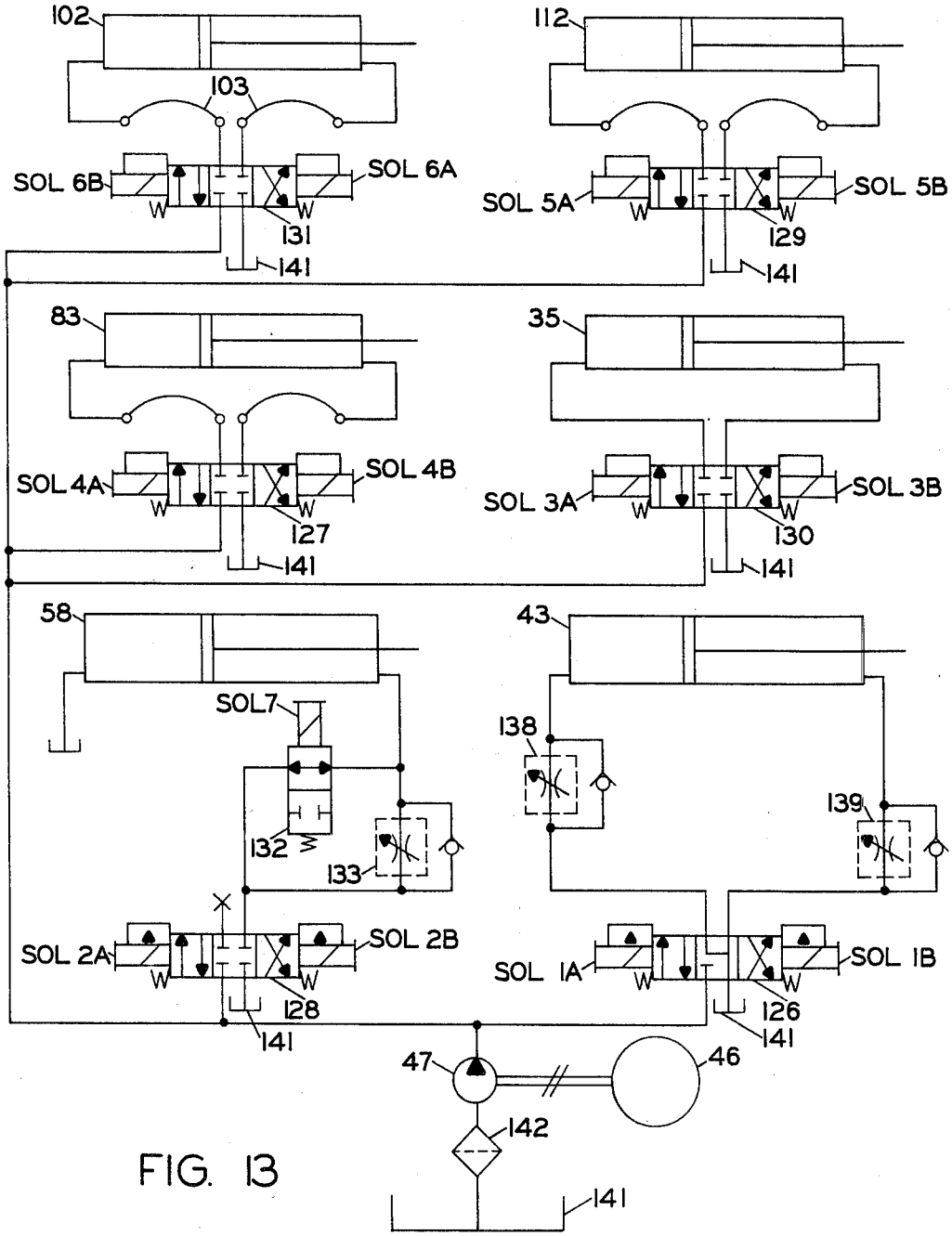
FIG. 13 is a schematic view of the hydraulic controls of the apparatus of FIG. 1.
Figure 15A:
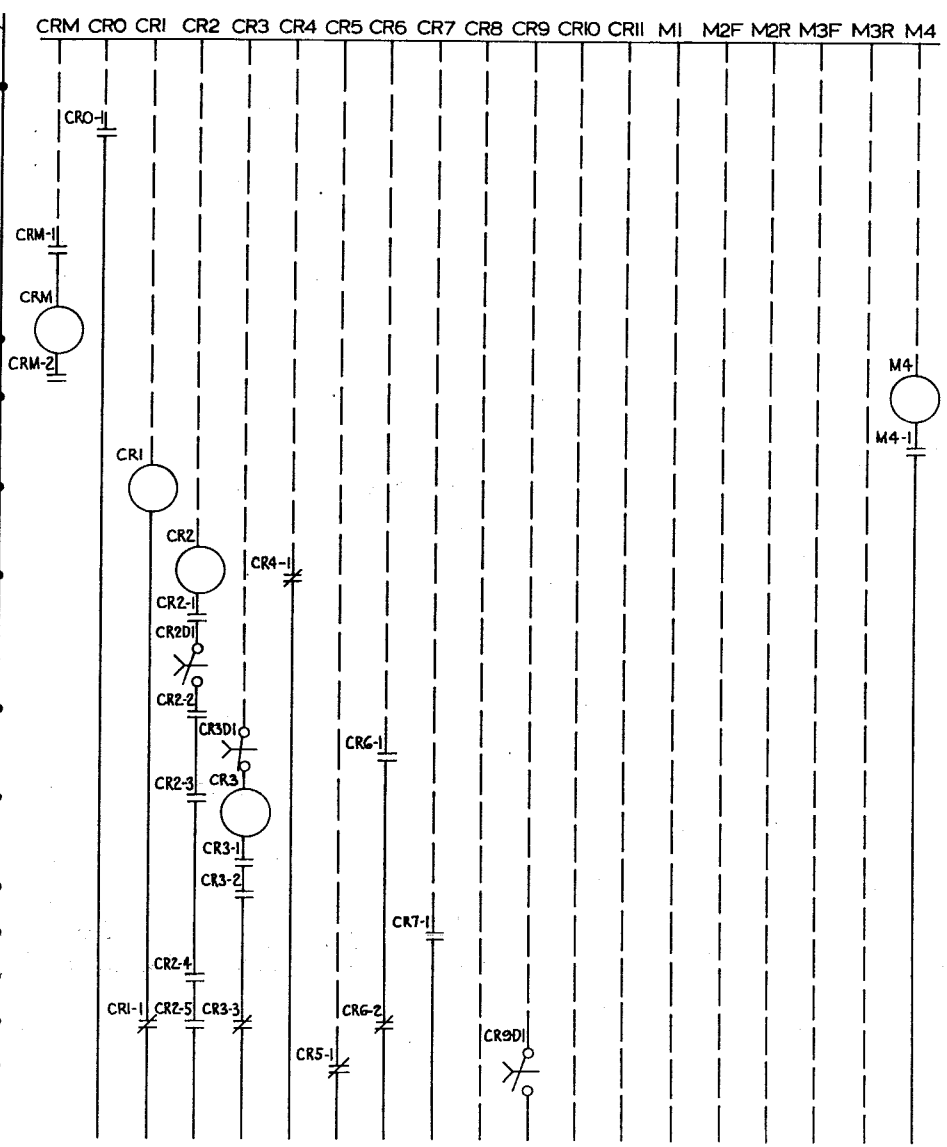
FIGS. 15A–C are schematic keys to the corresponding electrical schematic diagrams of FIGS. 14A–C.
Figure 14A:
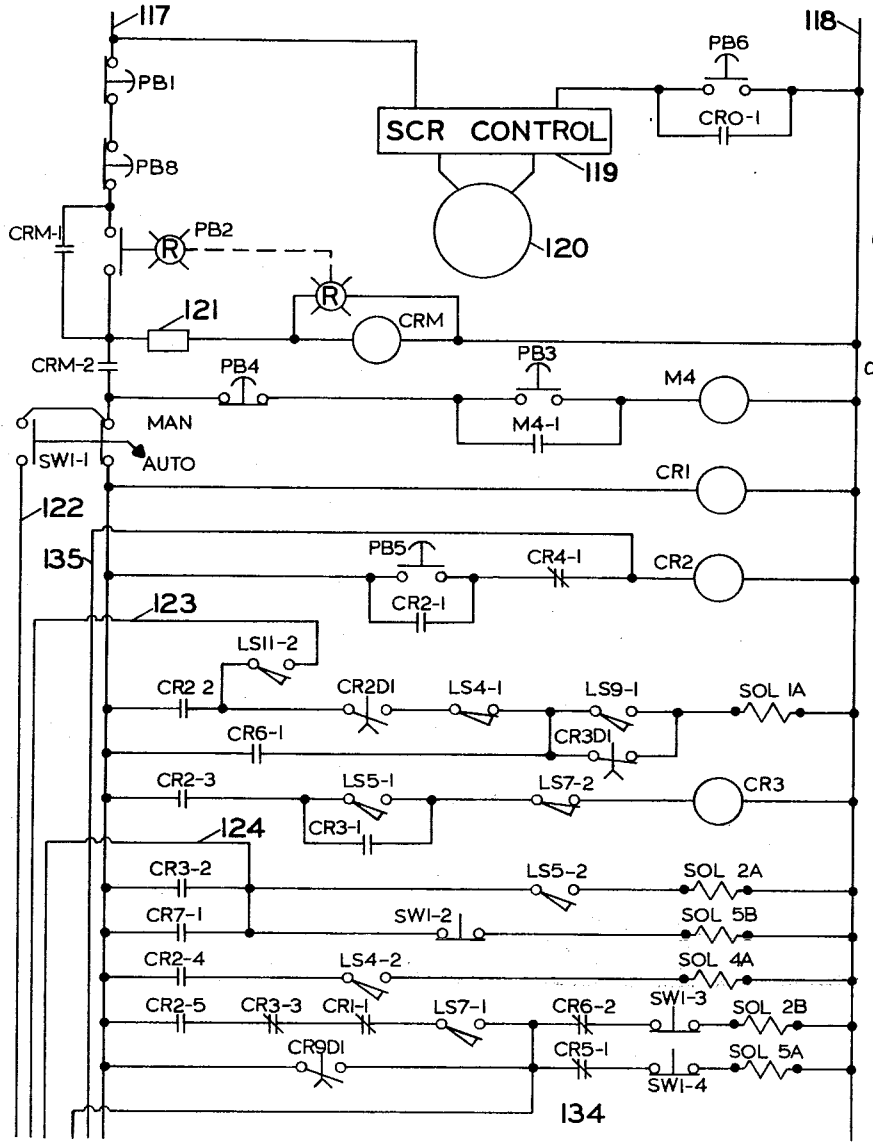
FIGS. 14A–C are schematic views of the electrical control portion of the apparatus of FIG. 1.
Figure 15B:
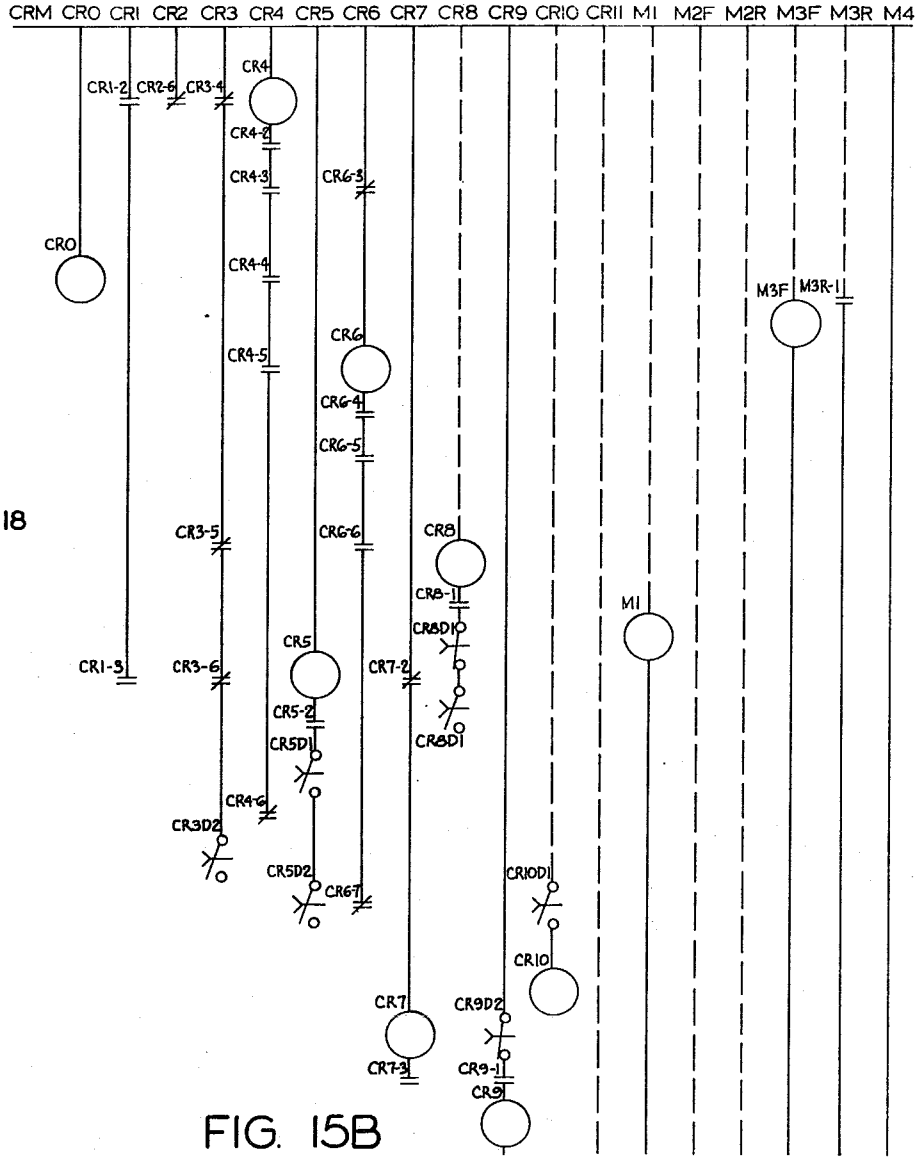
Figure 14B:
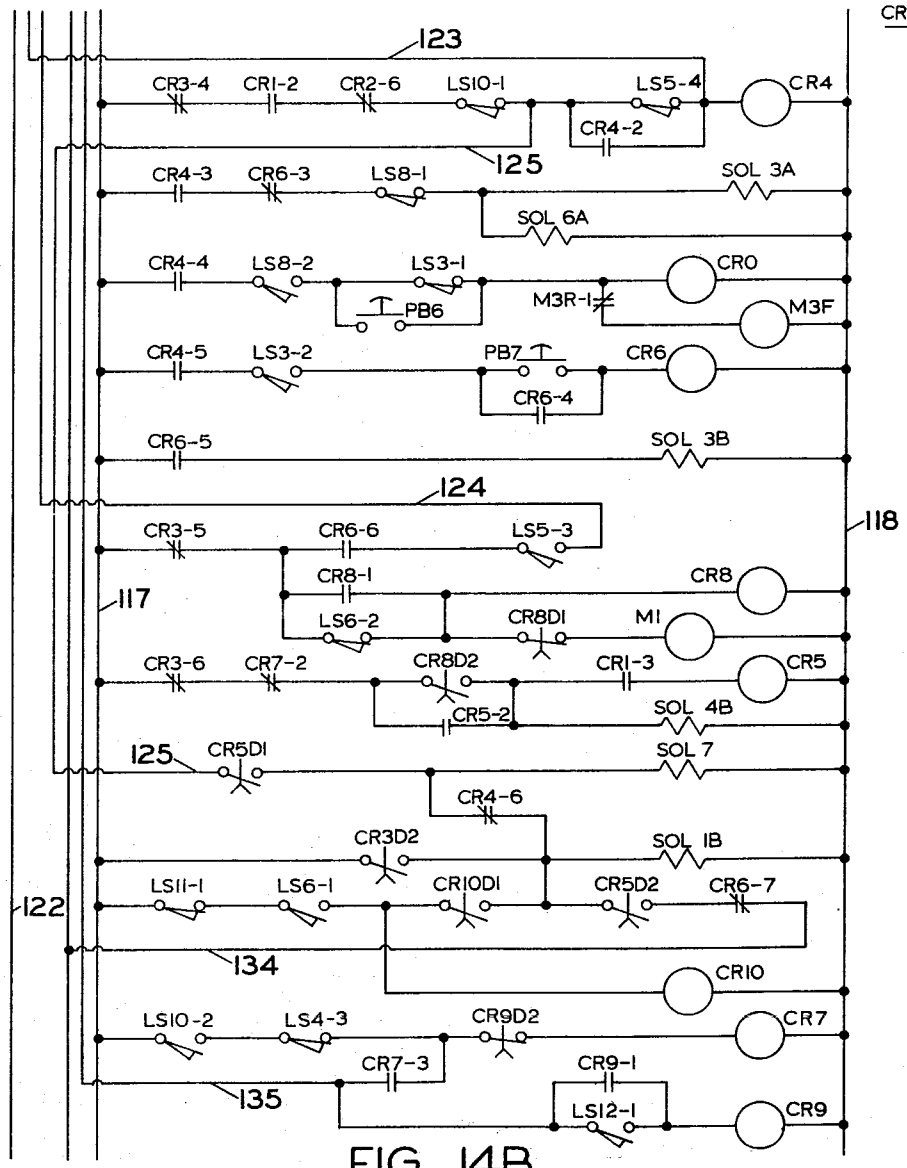
Figure 15C:
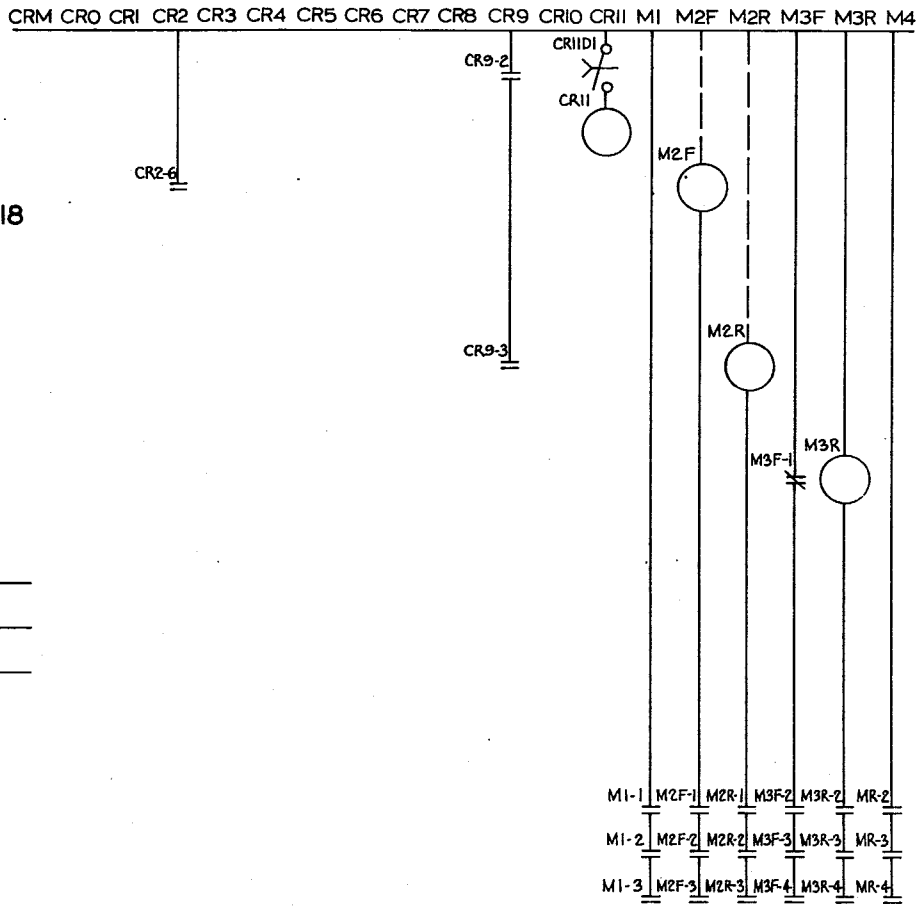
Figure 14C:
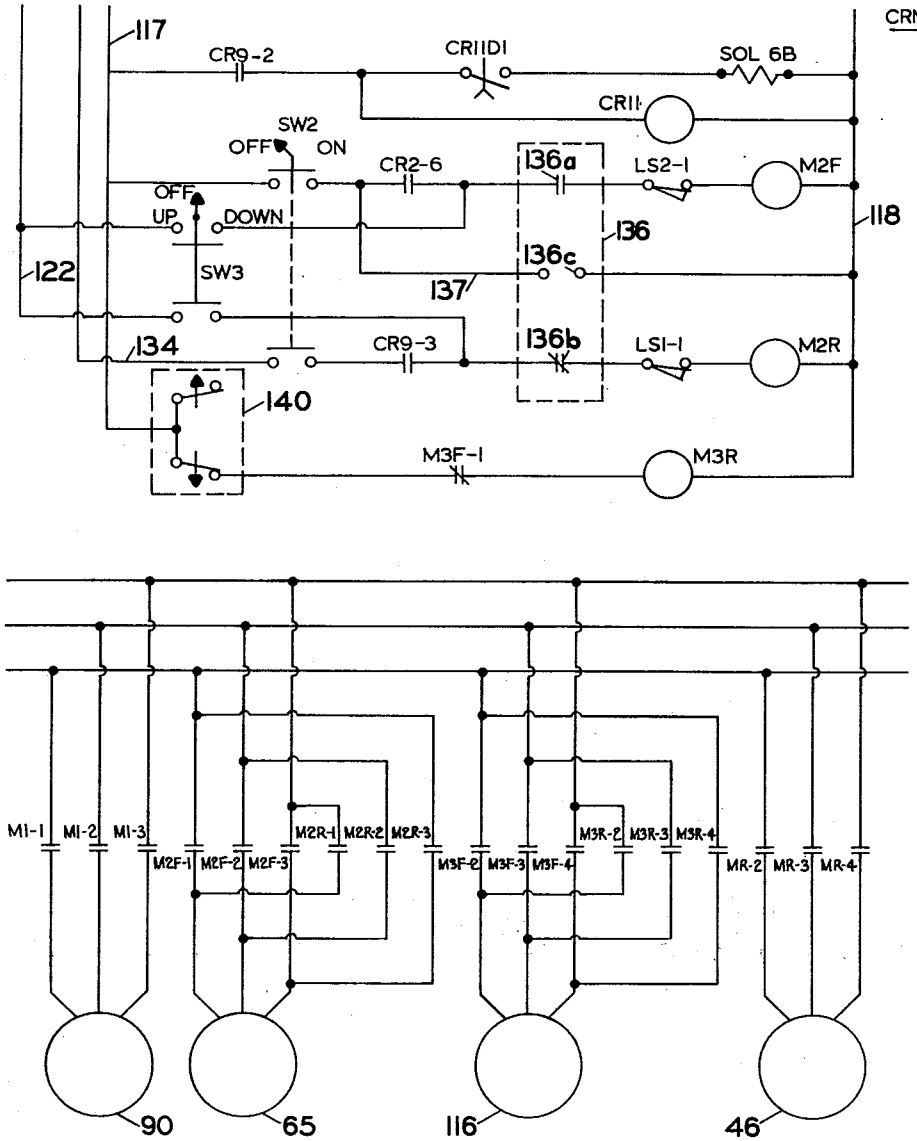

The electrical controls for the automatic operation of our apparatus 20 are shown schematically in FIGS. 14A–C, wherein these figures illustrate an across-the-line representation of the relay controls of our apparatus. FIGS. 15A–C provide a key to the respective relay diagrams, wherein each labeled vertical string illustrates the position of a control relay coil and its controlled contacts in the corresponding electrical schematic diagrams of FIGS. 14A–C. FIG. 13 is a schematic diagram of the hydraulic components of our apparatus and their related electrical controls.

With reference to FIG. 14A, a conducting line 117 is provided upon which may be impressed standard operating voltage such as 110 v. A.C. line voltage, with a second conducting line 118 being provided as the "neutral" or return line. The conducting lines 117 and 118 may also be two of the shape conducting lines of a three phase power system.

The power line 117 is connected to a variable voltage SCR (Silicon Controlled Rectifier or Thyristor bridge) motor control 119 which supplies power to a DC motor 120 which operates the concrete supply conveyor 33. The SCR control 119 is connected to the return line 118 through the parallel combination of a normally open push button switch PB6 and a normally open relay contact CRO-1. The SCR control 119 allows adjustment of the speed of the conveyor and thus the rate of feeding of fluid concrete to the mold.

Power is transmitted on the conducting line 117 to the remainder of the control circuitry through normally closed push button switches PB1 and PB8, with the opening of either PB1 or PB8 by an operator in an emergency serving to shut down power to all of the remaining control circuitry. Closure of a push button switch PB2 by the operator causes power to be supplied to the master relay coil CRM which closes normally open relay contacts CRM-1 and CRM-2, resulting in the continued supply of power to coil CRM and to the remainder of the control circuitry. Normally closed overload relay contacts 121, which are controlled by overload relay coils (not shown) in the power circuitry of each of the electric motors of our apparatus, is connected in series with the master relay coil CRM such that any overload will cause the power supply to the coil CRM to be shut off, thus shutting down the remainder of the circuit.

Power is supplied to a master relay coil M4, which controls the supply of power to the electric motor 46 driving the main hydraulic pump 47 through a normally closed push button switch PB4 and the parallel combination of a normally open push button PB3 and a normally open control relay contact M4-1. Closure of the push button PB3 by the operator causes the coil M4 to be activated, thus closing relay contact M4-1 and continuing the supply of power to the coil M4. This causes activation of the hydraulic power unit motor 46 and the generation of pressure in the hydraulic fluid system.

A mode selection switch SW1 is provided for selection of either a manual or automatic control mode. The automatic mode electrical controls are shown in FIGS. 14A–C, however, it is apparent that manual control of the electrical control components may be easily implemented. With the switch SW1 placed in its automatic position, power is supplied to a control relay coil CR1, which, as shown by the key diagram of FIG. 15A, opens normally closed relay contacts CR1-1 in the relay line which supplies power to a solenoid SOL2B which controls the upward movement of the mold carrier 38 and compaction member 86, closes normally open contacts CR1-2 in a relay line which includes a relay coil CR4, and closes normally open relay contacts CR1-3 in the relay line which supplies power to a relay coil CR5 which controls the finishing of the product. It may be noted that the relay coil CR1 remains activated as long as the switch SW1 is in the automatic mode position. Placement of the switch SW1 in the manual position deactivates the automatic controls and provides power to a conducting line 122.

Power is supplied to a start cycle relay coil CR2 through the parallel combination of a normally open push button switch PB5 and a normally open relay contact CR2-1, connected in series with a normally closed relay contact CR4-1. Closure of the push button PB5 by the operator causes power to be supplied to the relay coil CR2, thus activating relay contacts CR2-1 and maintaining coil CR2 activated. Activation of coil CR2 causes the closure of normally open relay contacts CR2-2, and the closure of normally open time delay relay contacts CR2D1 which have an off delay of 1 second, in the relay line which supplies power through normally closed segment LS4-1 of the limit switch LS4 and a normally open segment LS9-1 of the limit switch LS9 to a solenoid SOL1A. When the solenoid SOL1A is activated, the carriage 40 is moved toward the forming position, as will be described in further detail below.

Activation of the relay coil CR2 also results in: closure of a relay contact CR2-3 in a relay line which includes a relay coil CR3; closure of a relay contact CR2-4 in a conducting line which includes a solenoid SOL4A which controls the opening of the pick-up arms 80 and 81; closure of a relay contact CR2-5 in the relay line supplying power to a solenoid SOL2B which controls upward motion of the mold carrier 50; and opening of a normally closed relay contact CR2-6 in the relay line which supplies power to a relay coil CR4. If the mold carrier 50 is in a down position with the mold 38 resting on the table 39, the limit switch LS4 is closed, which allows power to be transmitted through relay contacts CR2-4, and a normally open segment LS4-2 of the limit switch LS4, to a solenoid SOL4A. The solenoid SOL4A operates a hydraulic valve 127 which supplies hydraulic fluid to the cylinder-piston unit 83 to move the pick-up arm units 80 and 81 to their open position and thereby release the mold 38. When the pick-up arm units 80 and 81 reach their open (or inward) position, the limit switch LS7 is closed, thus supplying power through a normally open segment LS7-1 thereof to a solenoid SOL2B which controls a hydraulic valve 128 to supply hydraulic fluid under pressure to the cylinder-piston unit 58 to raise the mold carrier. Power is also supplied, through the limit switch segment LS7-1, to a solenoid SOL5A which operates a hydraulic valve 129 to provide hydraulic fluid to the cylinder-piston unit 112, which thus raises the spacer fingers 105 above the surface of the table 39.

When the mold carrier reaches the top of the tower 22, the limit switch LS6 is closed, which results in the supply of power through a limit switch segment LS6-1 to a control relay coil CR10. A set of time delay relay contacts CR10D1 are closed preferably 5 seconds after activation of the relay coil CR10 to supply power to a solenoid SOL1B which operates a valve 126 to provide hydraulic fluid under pressure to the cylinder-piston unit 43 to move the carriage 40 toward the loading position. Closure of the time delay relay contacts CR10D1 also supplies power through normally closed relay contacts CR4-6 to activate a solenoid SOL7. The solenoid SOL7 operates a shut-off valve 132 which diverts the hydraulic fluid supplied through the valve 128 to a restrictor 133 which reduces the pressure of the fluid supplied to the cylinder-piston unit 58 and thus slows the rise of the mold carrier 50. When the carriage 40 reaches the loading position, a normally closed segment LS11-1 of the limit switch LS11 is opened, and the power to the solenoids SOL1B and SOL7 is shut off. Also, a normally open segment LS11-2 of the limit switch LS11 is closed, which provides a current path through closed relay contacts CR2-2, through the limit switch segment LS11-2 to a conducting line 123, and thence to a relay coil CR4, the activation of which causes initiation of the loading cycle. Activation of relay coil CR4 opens normally closed relay contacts CR4-1 and thereby cuts off power to relay coil CR2. Deactivation of coil CR2 opens the relay contacts CR2-5 and thus shuts off power to solenoids SOL2B and SOL5A. The hydraulic valves 126-131 are spring loaded as shown in FIG. 13 and return to a neutral position blocking flow therethrough when power to their control solenoids is shut off. Normally open relay contacts CR4-3 are also closed to cause activation of solenoid SOL3A through relay contacts CR4-3, relay contacts CR6-3, and a normally closed segment LS8-1 of the limit switch LS8, wherein the activation of solenoid SOL3A operates a hydraulic valve 130 to cause the cylinder-piston unit 35 to move the chute 34 toward its extended position. Power is also supplied through relay contacts CR4-3, relay contacts CR6-3, and the limit switch segment LS8-1 to solenoid SOL6A, activation of which operates a hydraulic valve 131 which causes the cylinder-piston unit 102 to move the product support plates 95 to their extended position. When the chute is fully extended, it trips limit switch LS8 which opens the normally closed segment LS8-1 of limit switch LS8 and thus shuts off power to the solenoids SOL3A and SOL6A.

The tripping of limit switch LS8 causes a normally open segment LS8-2 thereof to transmit power therethrough from closed relay contacts CR4-4 through a normally closed segment LS3-1 of the limit switch LS3 to a relay coil CR0 which causes closure of relay contacts CR0-1 to turn on the conveyor motor 120 and thus deliver fluid concrete at a controlled rate to the chute 34. The closure of the limit switch segment LS8-2 also causes power to be supplied through closed relay contacts M3R-1 to a relay coil M3F which closes contacts M3F-2, M3F-3, and M3F-4 in the power supply to the table motor 116 to cause rotation of the table 39 in a chosen forward direction of rotation. When the table 39 has completed a complete revolution, the limit switch LS3 is tripped, opening switch segment LS3-1, which shuts off power to the relay coil CR0 and thus turns off the conveyor motor, and which also shuts off power to the relay coil M3F, thereby cutting off power to the table motor.

The tripping of limit switch LS3 also causes power to be transmitted to relay coil CR6 through limit switch segment LS3-2, which results in the closure of relay contacts CR6-5 to supply power to a solenoid SOL3B. The solenoid SOL3B controls the hydraulic valve 130 to cause the cylinder-piston unit 35 to withdraw the chute 34 from its extended position to its withdrawn position. The activation of relay coil CR6 also causes relay coil contacts CR6-1 to close to supply power therethrough and through the normally open limit switch segment LS9-1, which is closed when the chute 34 returns to its withdrawn position, thus supplying power to the solenoid SOL1A which controls the hydraulic valve 126 to provide hydraulic fluid to the cylinder-piston unit 43 to move the carriage 40 toward the forming position. Adjustable fluid flow restrictors 138 and 139 are placed in the hydraulic lines supplying the cylinder-piston unit 43 to allow adjustable control of the speed of movement of the carriage 40.

When the forming position is reached by the carriage 40 a limit switch LS5 is tripped, closing a limit switch segment LS5-1 to activate a control relay CR3, and also completing a conducting path through a closed segment LS5-2 of limit switch LS5 to a solenoid SOL2A which controls the hydraulic valve 128 to move the mold carrier 50 downwardly. As the mold carrier 50 moves downwardly from its top position, a normally closed segment LS6-2 of the limit switch LS6 is closed to supply power conducted thereto by a conducting line 124 and limit switch segment LS5-3 to a relay coil CR8 when relay contacts CR6-6 are closed. Activation of the coil CR8 closes relay contacts CR8-1 to continue supply of power to the coil CR8, and results in the delayed opening of the time delay relay contacts CR8D1 and the delayed closing of relay contacts CR8D2, each of which preferably have a 15 second delay. Thus, for 15 seconds after the coil CR8 is activated, relay contacts CR8D1 remain closed to provide power to a relay coil M1 which causes closure of relay contacts M1-1, M1-2, and M1-3 to provide power to the vibrator motor 90. Closure of relay contacts CR8D2 after the 15 second delay provides a conducting path therethrough to a relay coil CR5 and to a solenoid SOL4B which controls the hydraulic valve 127 to cause the cylinder-piston unit 83 to move the pick-up arm units to their closed position holding the mold 38. Compaction of the fluid concrete in the mold takes place during the chosen time delay period.

Activation of the relay coil CR5 opens the normally closed relay contacts CR5-1 in the conducting path to the solenoid SOL5A which controls the raising of the spacer fingers. A time delay relay contact CR5D1 is closed after a 3 second delay, to complete a conducting path through relay contacts CR3-4, CR1-2, CR2-6, a normally closed segment LS10-1 of the limit switch LS10, a conducting line 125, and the relay contacts CR5D1, to the solenoid SOL7 which controls the hydraulic valve 132 such that raising of the mold carrier will be at a slow rate. Another set of time delay relay contacts CR5D2 is also closed, preferably 3 seconds after activation of the relay coil CR5.

During location of the mold 38 by the spacer fingers 105, the forming table 39 is rotated slightly which results in the opening of limit switch LS3 and thus the deactivation of relay coil CR6. A plugging switch 140 may also be utilized such that momentary closure of the switch 140 will activate the relay coil M3R, thereby closing relay contacts M3R-2, M3R-3, and M3R-4 to cause momentary rotation of the motor 116 and table 39 to release the limit switch LS3. After closure of the relay contacts CR5D2, a conducting path is thus completed through normally closed relay contacts CR6-2 to activate the solenoid SOL2B and move the mold carrier 50 and mold 38 upwardly at a slow rate. The delayed closing of relay contacts CR5D2 also provides a conducting path therethrough to the solenoid SOL1B to move the carriage 40 and table 39 out of the forming position.

When the carriage 40 reaches the far end of its travel so that it is not in interference with the vertical motion of the mold 38 and mold carrier 50, the limit switch LS10 is tripped, which opens the segment LS10-1 of the limit switch LS10 to cut off power to the relay coil CR4.

Opening of the limit switch segment LS10-1 also cuts off the power supplied therethrough and through the conducting line 125 to solenoids SOL7 and SOL1B, and further cuts off the power supplied through the conducting line 134 to the solenoid SOL2B. This results in stoppage of the motion of the carriage and the mold carrier.

Tripping of the limit switch LS10 provides a current path through a normally open segment LS10-2 thereof and through normally closed time delay relay contacts CR9D2 to activate a relay coil CR7. Normally open relay contacts CR7-3 are thereby closed to provide power to a conducting line 135 and therethrough to the relay coil CR2. Relay contacts CR7-1 are also closed to provide power to a solenoid, SOL5B which results in withdrawal of the spacer fingers. Power is also provided through contacts CR7-1 and limit switch segment LS5-2 to the solenoid SOL2A to cause downward movement of the mold carrier carrying the mold 38 and concrete product therein.

When the mold carrier 50 reaches the lower limit of its travel, the limit switch LS12 is tripped, which completes a current path through a normally open segment thereof LS12-1 to a relay coil CR9.

Activation of the relay coil CR9 opens normally closed relay contacts CR9D2 (which have a 3 second ON delay) and deactivates relay coil CR7, which results in the opening of contacts CR7-1 to thus shut off power to solenoids SOL2A and SOL5B, halting the downward movement of the mold carrier. Activation of the coil CR9 also causes closure of relay contacts CR9-2, which thereby results in activation of relay coil CR11. Time delay relay contacts CR11D1 are closed preferably 2 seconds after activation of relay coil CR11, resulting in the activation of a solenoid SOL6B which causes the product support plates 95 to be withdrawn to allow ejection of the shaped product out of the bottom of the mold.

Closure of the relay contacts CR2-6 and CR9-3 supplies power to normally open relay contacts **136*a* and normally closed relay contacts 136*b* of a photoelectric scanner unit 136. The photocell 136*c* of the photoelectric unit 136 is provided with electrical power by a conducting line 137. A switch SW2 is provided to turn off automatic operation of the stacker 60 when desired. The power supplied to the conducting line 134, which is connected to relay contact CR9-3, is delayed for 3 seconds by the time delayed closing of relay contacts CR9D1. Thus, power is first supplied through closed relay contacts CR2-6 and 136*a*, and normally closed limit switch LS2, to a relay coil M2F, which closes relay contacts M2F-1, M2F-2 and M2F-3 to supply power to the stacker motor 65 to cause the stacker unit 60 to move upwardly. Upward motion of the stacker 60 continues until the stacker trips the limit switch LS2, opening a limit switch segment LS2-1, or until the light beam of the photoelectric unit 136 is interfered with by a previously deposited product on the stacker, thus opening the contact 136***a*.

When the shaped product is deposited on the stacker 60, the light beam of the scanner 136 is broken, and the contacts 136*b* are closed. After closure of time delay relay contacts CR9D1, power is supplied through the contact 136B and a normally closed segment LS1-1 of the limit switch LS1, to a relay coil M2R which closes relay contacts M2R-1, M2R-2 and M2R-3 to reverse the supply of electricity to the stacker motor 65 and thereby cause the stacker to move downwardly until the light beam of the scanner 136 is uninterrupted. The loading cycle of the stacker may be repeated until the stacker reaches bottom and trips the limit switch LS1.

The closure of time delay relay contacts CR9D1 also supplies power to the solenoid SOL2B which causes upward movement of the mold carrier 50, and to the solenoid SOL5A, which results in the raising of the spacer fingers.

When the mold carrier raises sufficiently to release the limit switch LS4, a conducting path is provided through relay contacts CR2-2 and CR2D1, limit switch segment LS4-1, and closed limit switch segment LS9-1 to the solenoid SOL1A, which results in movement of the carriage 40 and forming table 39 towards the forming position. This completes the cycle and allows the loading and forming cycle to be reinitiated.

The operation of the stacker 60 may also be controlled manually by placing the switch SW1 in its manual position and placing the switch SW2 in its OFF position. A switch SW3 is provided which selectively connects the relay contacts 136*a* or 136*b* to the conducting line 122, thereby either raising or lowering the stacker as desired.

With reference to FIG. 13, the various solenoid controlled valves 126–131 are shown schematically returning the hydraulic fluid to a common reservoir 141. The reservoir 141 is also shown for illustrative purposes in FIG. 1. The hydraulic pump 47, which may be any common type which provides hydraulic fluid at a substantially constant pressure, preferably receives hydraulic fluid through a filter shown schematically at 142 in FIG. 3.

It is understood that our invention is not confined to the particular construction and arrangement of parts herein illustrated and described, but embraces all such modified forms thereof as come within the scope of the following claims.

We claim:

1. Apparatus for producing shaped concrete products, comprising:

a. a concrete mold having an inner form wall and an outer form wall spaced apart to define the vertical shape of a concrete product to be formed, said concrete mold being open at the top and bottom thereof and having withdrawable support means at the bottom of said mold for providing vertical support to a shaped product within said mold and for selectively withdrawing support from the shaped product to allow release thereof from the bottom of said mold;

b. vertically movable mold carrier means operatively associated with said mold for selectively engaging and grasping said mold, for carrying said mold in vertical movement therewith, and for selectively releasing said mold;

c. carriage means operatively associated with said mold for providing vertical support to the bottom of said mold and to the bottom of fluid concrete contained within said mold and for moving in selected horizontal movement;

d. feeding means operatively associated with said mold for discharging a selected amount of fluid concrete into said mold when said mold is supported by said carriage means in a feeding position wherein said mold is positioned to receive fluid concrete discharged by said feeding means, whereby the fluid concrete in said mold assumes the vertical shape of said inner and outer form walls of said mold;

e. shaped product support means positioned beneath said mold carrier means for receiving and supporting shaped concrete products discharged from the bottom of said mold, whereby when said mold is held by said mold carrier means and a shaped product within said mold is supported by said withdrawable support means, said carriage means may be moved horizontally to a position which allows said mold carrier means to descend with said mold to a position wherein the shaped product may be released from said mold by withdrawal of said withdrawable support means and may thereafter be supported by said shaped product support means.

2. The apparatus of claim 1 including compaction means movable vertically above said mold when said mold is in a forming position supported beneath said compaction means by said carriage means, and having a compaction member substantially conforming in shape to the spacing between said inner and outer form walls of said mold, said compaction means adapted to selectively insert said compaction member into said mold and into contact with fluid concrete therein to apply pressure to the concrete.

3. The apparatus of claim 2 including vibrating means operatively associated with said compaction member for vibrating said compaction member when it is in contact with fluid concrete in said mold.

4. The apparatus of claim 2 including control and drive means operative for moving said carriage means and mold support thereon to the feeding position thereof, for controlling said feeding means to discharge a selected amount of fluid concrete into said mold when said mold is in its feeding position, for moving said carriage means and mold carried thereon to its forming position after fluid concrete has been discharged into said mold, for controlling said compaction means to insert said compaction member into said mold to apply pressure to and compact the fluid concrete therein and to withdraw said compaction member from said mold after said compaction member has applied pressure to the fluid concrete for a selected period of time, for moving said mold carrier means into engagement with said mold and for controlling said mold carrier means to grasp said mold, for moving said carriage means to a position wherein it does not interfere with the vertical movement of said mold and mold carrier means, for moving said mold carrier means and said mold carried therewith vertically to a position wherein a shaped concrete product discharged from the bottom of said mold will be supported by said shaped product support means, and for controlling said withdrawable support means of said mold to withdraw support from a shaped product within said mold to allow release of the shaped product to said shaped product support means.

5. The apparatus of claim 4 including vibrating means operatively associated with said compaction member for vibrating said compaction member and wherein said control means controls said vibrating means to selectively vibrate said compaction member when it is in contact with fluid concrete in said mold.

6. The apparatus of claim 1 including a compaction member operably mounted for vertical movement to said mold carrier means and adapted to fit closely between said inner and outer form walls of said mold, said compaction member being mounted to said mold carrier means in position to be inserted into the space between said inner and outer form walls and into contact with fluid concrete therein to apply pressure to the concrete when said mold carrier is engaged with said mold.

7. The apparatus of Claim 6 including vibrating means operatively associated with said compaction member for vibrating said compaction member when it is in contact with fluid concrete in said mold.

8. The apparatus of Claim 1 wherein said inner and outer form walls of said mold are circular, and wherein said carriage means selectively rotates said mold when said mold is supported by said carriage means, whereby said mold may be filled by said feeding means by rotating said mold while fluid concrete is discharged into said mold by said feeding means.

9. The apparatus of claim 1 wherein said carriage means includes a forming table adapted to provide vertical support to said mold and to fluid concrete therein, said carriage means also including means for rotating said forming table.

10. The apparatus of claim 9 wherein said forming table has a plurality of openings therein spaced around said table, said carriage means including spacer finger members having a portion thereof which may be extended into said openings in said forming table and above the surface of said table, said carriage means also including means for selectively extending said spacer finger members above the surface of said forming table and for withdrawing said spacer finger members below the surface of said table, and wherein said inner and outer form walls of said mold have notches therein at the bottom of said mold in position to allow said spacer finger members to be inserted therein and thereby facilitate alignment of said mold.

11. The apparatus of claim 1 including control and drive means operative for moving said carriage means and mold supported thereon to the feeding position thereof, for controlling said feeding means to discharge a selected amount of fluid concrete into said mold when said mold is in its feeding position, for moving said carriage means and mold carried thereon to a position wherein the mold is engageable by said mold carrier means, for moving said mold carrier means into engagement with said mold and for controlling said mold carrier means to grasp said mold, for moving said carriage means to a position wherein it does not interfere with the vertical movement of said mold and mold carrier means, for moving said mold carrier means and said mold carried therewith vertically to a position wherein a shaped concrete product discharged from the bottom of said mold will be supported by said shaped product support means, and for controlling said withdrawable support means of said mold to withdraw support from a shaped product within said mold to allow release of the shaped product to said shaped product support means.

12. The apparatus of claim 1 wherein said shaped product support means is vertically movable to allow a plurality of shaped products to be discharged onto and supported by said shaped product support means in stacked relation.

13. Apparatus for producing shaped concrete products, comprising:

a. a support frame having a vertically disposed tower portion and a horizontally extending portion;

b. a concrete mold operatively associated with said frame having an inner form wall and an outer form wall spaced apart to define the vertical shape of a concrete product to be formed, said mold being open at the top and bottom thereof and also having withdrawable support means at the bottom of said mold for providing vertical support to a shaped product within said mold and for selectively withdrawing support from the shaped product to allow release thereof from the bottom of said mold;

c. mold carrier means, supported for vertical movement by said vertically disposed tower portion of said support frame, for selectively engaging and grasping said mold and carrying said mold in vertical movement therewith, and for selectively releasing said mold;

d. carriage means, supported for horizontal movement by said horizontally extending portion of said support frame, and including a forming table adapted to provide vertical support to said mold and to fluid concrete therein; and e. compaction means, supported by said tower portion of said frame for vertical movement above said mold and including a compaction member substantially conforming in shape to the spacing between said inner and outer form walls of said mold, said compaction means adapted to selectively insert said compaction member into said mold and into contact with fluid concrete therein to apply pressure to the concrete.

14. The apparatus of claim 13 including vibrating means operatively associated with said compaction member for vibrating said compaction member when it is in contact with fluid concrete in said mold.

15. The apparatus of claim 13 wherein said compaction means is operably mounted to said mold carrier means with said compaction member in position to be inserted into the space between said inner and outer form walls and into contact with fluid concrete therein to apply pressure to such concrete.

16. The apparatus of claim 15 including vibrating means operatively associated with said compaction member for vibrating said compaction member when it is in contact with fluid concrete in said mold.

17. The apparatus of claim 13 including feeding means supported by said support frame for discharging a selected amount of fluid concrete into said mold when said mold is supported by said forming table in a feeding position wherein said mold is positioned to receive fluid concrete discharged by said feeding means, whereby the fluid concrete in said mold assumes the vertical shape of said inner and outer form walls of said mold.

18. The apparatus of claim 17 wherein said inner and outer form walls of said mold are circular, and wherein said carriage means includes means for selectively rotating said forming table when said mold is supported by said forming table, whereby said mold may be filled by said feeding means by rotating said forming table while fluid concrete is discharged into said mold by said feeding means.

19. The apparatus of claim 17 including shaped product support and stacker means for receiving and supporting shaped concrete products discharged from the bottom of said mold, said stacker means being supported for vertical movement on said tower portion of said support frame at a position below said carriage means to allow a plurality of shaped products to be discharged onto and supported by said support and stacker means in stacked relation whereby when said mold is held by said mold carrier means and a shaped product within said mold is supported by said withdrawable support means, said carriage means may be moved laterally to a position which allows said mold carrier means to descend with said mold until the bottom of said mold is at the level of said stacker means or of a previously deposited product thereon and whereby the shaped product may be released from said mold by withdrawal of said withdrawable support means.

20. The apparatus of claim 19 including control and drive means operative for moving said carriage means and mold supported thereon to the feeding position thereof, for controlling said feeding means to discharge a selected amount of fluid concrete into said mold when said mold is in its feeding position, for moving said carriage means and mold carried thereon to its forming position after fluid concrete has been discharged into said mold, for controlling said compaction means to insert said compaction member into said mold to apply pressure to and compact the fluid concrete therein and to withdraw said compaction member from said mold after said compaction member has applied pressure to the fluid concrete for a selected period of time, for moving said mold carrier means into engagement with said mold and for controlling said mold carrier means to grasp said mold, for moving said carriage means to a position wherein it does not interfere with the vertical movement of said mold and mold carrier means, for moving said mold carrier means and said mold carried therewith vertically to a position wherein a shaped concrete product discharged from the bottom of said mold will be supported by said shaped product support and stacker means, and for controlling said withdrawable support means of said mold to withdraw support from a shaped product within said mold to allow release of the shaped product to said shaped product support and stacker means.

21. The apparatus of claim 20 including vibrating means operatively associated with said compaction member for vibrating said compaction member and wherein said control means controls said vibrating means to selectively vibrate said compaction member when it is in contact with fluid concrete in said mold.

22. The apparatus of claim 13 wherein said forming table has a plurality of openings therein spaced around said table, said carriage means including spacer finger members having a portion thereof which may be extended into said openings in said forming table and above the surface of said table, said carriage means also including means for selectively extending said spacer finger members above the surface of said forming table and for withdrawing said spacer finger members below the surface of said table, and wherein said inner and outer form walls of said mold have notches therein at the bottom of said mold in position to allow said spacer finger members to be inserted therein and thereby facilitate alignment of said mold.

23. Apparatus for producing shaped concrete products, comprising:

a. a support frame having a vertically extending tower portion and a horizontally extending portion, said horizontally extending portion including a pair of horizontally disposed side rails;

b. a concrete mold operatively associated with said frame having an inner form wall and an outer form wall spaced apart to define the vertical shape of a concrete product to be formed, said mold being open at the top and bottom thereof and having a plurality of notches in said form walls at the top thereof with each said notch having a horizontally disposed slot portion, said mold also having withdrawable support means at the bottom thereof for providing vertical support to a shaped product within said mold and for selectively withdrawing support from the shaped product to allow release thereof from the bottom of said mold;

c. a carriage having wheels in rolling engagement with said side rails, said wheels supporting said carriage for horizontal movement, said carriage including a forming table adapted to provide vertical support to said mold and to fluid concrete therein;

d. a mold carrier having horizontally movable pick-up arm members with horizontally extending grasping finger members thereon, said grasping finger members being adapted to fit into said notches in said form walls of said mold and to hold said mold for vertical support thereof when said pick-up arm members are moved to their closed positions wherein said finger members are inserted into the slot portion of said notches in said form walls;

e. a compaction member substantially conforming in shape to the spacing between said inner and outer form walls of said mold and adapted to be inserted into said mold to contact and apply pressure to fluid concrete therein;

f. means operatively associated with said mold carrier for mounting said compaction member to said mold carrier such that said compaction member will be provided vertical support by said mold carrier when said compaction member is not in contact with fluid concrete in said mold and will move vertically with said mold carrier;

g. carriage drive means operatively associated with said frame for driving said carriage between a forming position, wherein said forming table is located beneath said mold carrier, and a withdrawn position wherein the carriage does not interfere with the vertical movement of said mold and said mold carrier; and h. mold carrier drive means supported by said vertical tower portion of said frame and operatively associated with said mold carrier for providing vertical support to said mold carrier and for driving said mold carrier vertically between a top position, wherein said mold carrier does not interfere with horizontal movement of said carriage and said mold supported on said forming table, an intermediate forming position, wherein said mold carrier holds said mold in place during compaction of concrete in said mold by said compaction member, and a bottom unloading position, wherein the shaped concrete product may be released from the bottom of said mold without interference by said carriage and forming table.

24. The apparatus of claim 23 including a shaped product stacker having a pair of product support racks, said product support racks being mounted by rollers to opposite sides of said tower portion of said support frame for vertical movement, said support racks extending toward each other in position to provide vertical support to a shaped concrete product released from the bottom of said mold, said shaped product stacker also having drive means for driving said product support racks in selected vertical movement and for maintaining said support racks in a desired vertical position.

25. The apparatus of claim 23 including feeding means supported by said support frame for selectively discharging a selected amount of fluid concrete to said mold, and wherein said carriage drive means selectively drives said carriage to an intermediate feeding position wherein said mold supported by said forming table is in position to be supplied with concrete discharged by said feeding means.

26. The apparatus of claim 25 wherein said feeding means includes (a) a concrete hopper adapted to receive and hold fluid concrete and to direct the concrete by gravity toward an opening in the bottom thereof, (b) an endless belt concrete conveyor mounted to said frame beneath said concrete hopper in position to receive concrete discharged by gravity from said hopper, (c) means for driving said concrete conveyor at a selected speed to receive concrete from said hopper and discharge it at a selected rate off of the end of said conveyor, and (d) a concrete guide chute positioned to receive concrete discharged from the end of said conveyor and to guide the concrete into said mold between said inner and outer form walls thereof.

27. The apparatus of claim 25 wherein said inner and outer form walls of said mold are circular, and wherein said carriage includes means for selectively rotating said forming table when said mold is supported by said forming table, whereby said mold may be filled by said feeding means by rotating said forming table while fluid concrete is discharged into said mold by said feeding means.

28. The apparatus of claim 23 including vibrating means operatively associated with said compaction member for vibrating said compaction member when it is in contact with fluid concrete in said mold.

29. The apparatus of claim 23 wherein said withdrawable support means of said mold include substantially flat horizontally disposed support plates which may be extended at least partially across the space between said inner and outer form walls at the bottom of said mold, means for slidingly mounting said support plates to said inner form wall to allow inward and outward horizontal movement of said support plates while providing vertical support to said support plates, and means for selectively driving said support plates between an extended position, wherein they at least partially block the space between said form walls at the bottom of said mold, and a withdrawn position wherein the support plates do not obstruct the bottom of said mold.

30. The apparatus of claim 23 wherein said forming table has a plurality of openings therein spaced around said table, said carriage including spacer finger members having a portion thereof which may be extended into said openings in said forming table and above the surface of said table, said carriage also including means for selectively extending said spacer finger members above the surface of said forming table and for withdrawing said spacer finger members below the surface of said table, and wherein said inner and outer form walls of said mold have notches therein at the bottom of said mold in position to allow said spacer finger members to be inserted therein and thereby facilitate alignment of said mold.

31. The apparatus of claim 23 including control means operative for controlling said carriage drive means and said mold carrier drive means to move said carriage to its forming position when said mold carrier and mold carried therewith are above said carriage, to move said mold carrier and mold down to engagement of said mold with said forming table when said carriage is in its forming position and to move said compaction member into contact with fluid concrete in said mold, to move said carriage out of interference with said mold carrier and said mold carried therewith after compaction of fluid concrete in said mold, to move said mold carrier and said mold carried therewith downwardly to the unloading position of said mold carrier, and to control said withdrawable support means at the bottom of said mold to withdraw support from a shaped concrete product in said mold and thereby allow release of the shaped concrete product.

32. A mold for forming shaped concrete products, comprising:

a. an outer form wall having a selected vertical shape to thereby define the exterior vertical shape of a concrete product to be shaped within the mold;
b. an inner form wall spaced inwardly from said outer form wall having a selected vertical shape to thereby define the interior vertical shape of a concrete product to be shaped within the mold;
c. horizontally disposed substantially flat support plates which may be extended at least partially across the space between said inner and outer form walls at the bottom of said mold;
d. means mounted to said inner form wall and operatively associated with said support plates for mounting said support plates to said inner form wall to allow inward and outward horizontal movement of said support plates while providing vertical support to said support plates; and
e. means operatively associated with said inner form wall for selectively driving said support plates between an extended position, wherein they partially block the bottom of said mold to provide vertical support to a shaped concrete product within said mold, and a withdrawn position wherein the support plates do not obstruct the bottom of said mold.

33. The mold of claim 32 wherein said means for driving said support plates includes a rotatable sprocket operably connected to each said support plate by a connecting rod such that rotation of said sprocket provides selected extension or retraction of said support plates depending on the direction of rotation of said sprocket, and means for selectively rotating said sprocket.

34. The mold of claim 33 wherein said sprocket includes a spur gear portion and wherein said means for rotating said sprocket includes a gear rack having gear teeth in engagement with the teeth on said spur gear portion, and a hydraulic cylinder-piston unit having the plunger thereof connected to said gear rack, said hydraulic cylinder-piston unit being responsive to fluid under presssure supplied thereto in one of two directions to drive said gear rack inwardly or outwardly depending on the direction of the fluid under pressure supplied to said cylinder-piston unit.

* * * * *